US007649728B2

(12) United States Patent
Fujita et al.

(10) Patent No.: US 7,649,728 B2
(45) Date of Patent: Jan. 19, 2010

(54) ELECTRICITY REMOVAL APPARATUS

(75) Inventors: Tsukasa Fujita, Osaka (JP); Tadashi Hashimoto, Osaka (JP)

(73) Assignee: Keyence Corporation, Osaka (JP)

( * ) Notice: Subject to any disclaimer, the term of this patent is extended or adjusted under 35 U.S.C. 154(b) by 229 days.

(21) Appl. No.: 11/959,556

(22) Filed: Dec. 19, 2007

(65) Prior Publication Data

US 2008/0151465 A1 Jun. 26, 2008

(30) Foreign Application Priority Data

Dec. 20, 2006 (JP) ..... 2006-343066
Dec. 20, 2006 (JP) ..... 2006-343067
Dec. 20, 2006 (JP) ..... 2006-343068

(51) Int. Cl.
*H05F 3/06* (2006.01)

(52) U.S. Cl. ..... 361/213

(58) Field of Classification Search ..... 361/213
See application file for complete search history.

(56) References Cited

U.S. PATENT DOCUMENTS 4,740,862 A * 4/1988 Halleck ..... 361/231
7,375,944 B2 * 5/2008 Izaki et al. ..... 361/230

FOREIGN PATENT DOCUMENTS

JP 2000-058290 2/2000
JP 2003-086393 3/2003

* cited by examiner

*Primary Examiner*—Stephen W Jackson
*Assistant Examiner*—Ann T Hoang
(74) *Attorney, Agent, or Firm*—Kilyk & Bowersox, P.L.L.C.

(57) ABSTRACT

The present invention relates to suppressing wear and contamination of the electrode needle as well as effectively removing the electricity from a charged body. An electricity removal mode in which the electrode needle is applied with a high voltage to produce ions and a halt mode in which the electrode needle is halted are provided, that are alternatively selected based on a selection of a user. The halt mode includes a halt period during which the high voltage is not basically applied on the electrode needle. When a self discharge occurs by approach of a charged body in this halt period and an absolute value of current that flows through the resistance exceeds the first threshold value, the electricity removal operation is initiated in which the high voltage is applied on the electrode needle to produce ions. Subsequently, after a predetermined time period passes, for example, the electricity removal operation is terminated and the halt period is resumed.

16 Claims, 25 Drawing Sheets

Fig. 7A Halt mode (3)
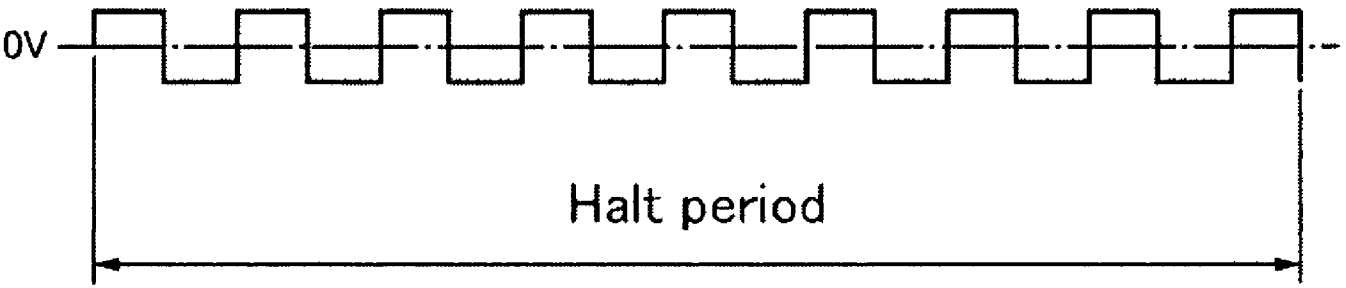
Fig. 7B Halt mode (4)
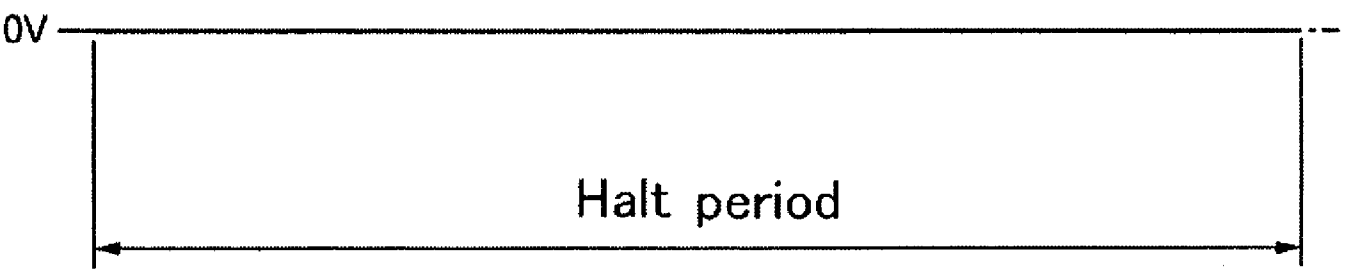

Control example in halt mode (1)

Control example in halt mode (2)

ELECTRICITY REMOVAL APPARATUS

CROSS-REFERENCE TO RELATED APPLICATION

The present application claims priority from Japanese Patent Application Nos. 2006-343066, 2006-343067, and 2006-343068, all filed on Dec. 20, 2006, the entire contents of which are hereby incorporated by reference.

BACKGROUND OF THE INVENTION

1. Field of the Invention

The present invention relates to an electricity removal apparatus for removing electricity of a charged body that is either positively or negatively charged.

2. Description of Related Art

An electricity removal apparatus, namely an ionizer, which removes the electricity of a charged body by producing positive or negative ions has been known (shown in Japanese Unexamined Patent Publication No. 2000-58290 and Japanese Unexamined Patent Publication No. 2003-86393). The electricity removal apparatus produces ions by a corona discharge onto an electrode needle by applying a high voltage. Thus, the electricity removal apparatus has a problem, wherein the capability of producing the ion, decreases over time as the electrode needle becomes worn away and tainted.

To address the above problem, Japanese Unexamined Patent Publication No. 2003-86393 shows a technique, based on an electricity removal apparatus for alternately producing positive ions and negative ions by applying high voltages having different polarities alternately onto a common electrode needle, for providing an interval during which no voltage is applied on the electrode needle after an application of a positive voltage before an application of a negative voltage, for example, as well as for adjusting a voltage to be applied on the electrode needle so that an ion balance becomes neutral immediately before the interval. As shown in the 2003-86393 publication, providing an interval between the application of voltages having different polarities can reduce the length of actual working hours of the electrode needle, thereby suppressing wear and contamination of the electrode needle as well as maintaining the ion balance appropriately.

SUMMARY OF THE INVENTION

An object of the present invention is to provide an electricity removal apparatus, namely an ionizer, which effectively removes electricity of a charged body while suppressing wear and contamination of an electrode.

According to a first embodiment, the above technical problem can be solved by providing an electricity removal apparatus that produces ions by an application of a high voltage on an electrode needle, the electricity removal apparatus including: an electrode to produce the ion; a voltage circuit connected to the electrode for generating a positive voltage and a negative voltage of electrical power to supply the electrical power to the electrode; a self discharge detection circuit for detecting a self discharge of the electrode; and a control unit for controlling the positive voltage and the negative voltage generated by the voltage circuit to one of a first condition in which the electrode does not produce the ion actively and a second condition in which the electrode produces the ion actively, shifting a voltage for the electrode corresponding to the first condition into a voltage for the electrode corresponding to the second condition when the self discharge is detected by the self discharge detection circuit, and shifting a voltage for the electrode corresponding to the second condition into a voltage for the electrode corresponding to the first condition when a requirement for termination is met.

According to a second embodiment, an emergence of a charged body while the electrode needle is halted induces a charge having an opposite polarity from the polarity of the charged body at a tip end of the electrode needle, and this makes the self discharge easily generated. Further, by detecting the generation of the self discharge by the self discharge detection circuit provided inside of the apparatus, it is possible not only to detect the emergence of the charged body, but also to initiate the electricity removal operation. Consequently, it is possible to automatically detect the emergence of the charged body by the electricity removal apparatus itself and to remove the electricity by the electricity removal apparatus, without depending on an external sensor. As a result, the electrode needle can normally be in a stand-by state without the high voltage being applied, thereby suppressing wear and contamination of the electrode needle and effectively removing the electricity of the charged body.

The self discharge detection circuit may be a circuit for detecting a value of current that flows through a resistance provided between the electrode needle and the high voltage producing circuit, or a circuit for detecting a value of current that flows through a resistance provided between the electrode needle and a ground. It is possible not only to detect the self discharge based on an absolute value of the current that flows through the resistance, but also to learn an effect of the electricity removal because the value (absolute value) of the current that flows through the resistance becomes smaller as an amount of charge of the charged body decreases. Therefore, by initiating the electricity removal operation when the value (absolute value) of the current that flows through the resistance exceeds the first threshold value, and terminating when the absolute value of the current that flows through the resistance goes below a second threshold value, it is possible to control the electricity removal operation in the halt mode in a manner corresponding to the emergence of the charged body. It is appreciated that a timer can be used to terminate the electricity removal operation such that the electricity removal operation is terminated after a predetermined time period after the initiation of the electricity removal operation to resume the halt period. In order to improve the sensitivity of the detection of a charged body, it is preferable to apply a relatively low level of high voltage so as not to produce ions at the electrode needle during the halt period.

According to another embodiment of the present invention, in addition to the halt mode which is normally in a halt state and the electricity removal operation is performed according to the emergence of the charged body, an electricity removal mode in which a high voltage is applied on the electrode needle to produce ions is provided in addition to the halt mode, and the electricity removal mode and the halt mode are arbitrarily settable according to a selection by a user. With this, it is possible for the user to select an operation of the electricity removal apparatus appropriate to an environment in which the electricity removal apparatus is accommodated.

In the halt mode, the halt period and an ion producing period in which a high voltage is applied on the electrode needle to produce ions are alternately set. According to this setting, it is possible to remove the electricity of the charged body that is slightly charged using ions produced in the ion producing period. While time lengths of the halt period and the ion producing period can be fixed, it is appreciated that the time lengths of the halt period and the ion producing period are preferably settable by the user arbitrarily.

In the halt mode, it is preferable to provide a transitional period between the halt period and the ion producing period or electricity removal operation. Specifically, by gradually decreasing the voltage applied to the electrode needle in a transition from the electricity removal operation or ion producing period to the halt period, it is possible to suppress unbalanced ions in an atmosphere around the electrode needle in the halt period depending on the polarity of the high voltage last applied in the ion producing period or electricity removal operation. On the other hand, by gradually increasing the voltage applied to the electrode needle in a transition from the halt period to the ion producing period or electricity removal operation, it is possible to suppress an occurrence of the problem where the charged body is influenced by an exposure of a body whose electricity is to be removed to ions that are produced abruptly around the electrode needle immediately after the transition to the ion producing period or electricity removal operation.

BRIEF DESCRIPTION OF THE DRAWINGS

FIG. 6A shows an example of applying a low level voltage that does not produce ions on an electrode needle during the halt period in the halt mode, and FIG. 6B shows an example of applying no voltage on the electrode needle during the halt period in the halt mode;

FIGS. 7A and 7B show examples of a control mode in the halt mode constituted only with the halt period without an ion producing period; FIG. 7A shows an example of applying a low level voltage that does not produce ions on the electrode needle during the halt mode (halt period), and FIG. 7B shows an example of applying no voltage on the electrode needle during the halt mode (halt period);

FIG. 13A shows an example in which no voltage is applied on the electrode needle in the halt period, and FIG. 13B shows an example in which a low voltage that does not produce ions is applied on the electrode needle in the halt period;

FIG. 14A shows an example in which no voltage is applied on the electrode needle in the halt period, and FIG. 14B shows an example in which a low voltage that does not produce ions is applied on the electrode needle in the halt period;

FIG. 15A shows an example in which no voltage is applied on the electrode needle in the halt period, and FIG. 15B shows an example in which a low voltage that does not produce ions is applied on the electrode needle in the halt period;

FIG. 22A shows a control example when the ion balance moves toward a plus side, FIG. 22B shows a control example when the ion balance moves toward a minus side;

DETAILED DESCRIPTION OF THE PREFERRED EMBODIMENTS

The following describes a preferred embodiment according to the present invention with reference to the appended drawings.

Figure 1:
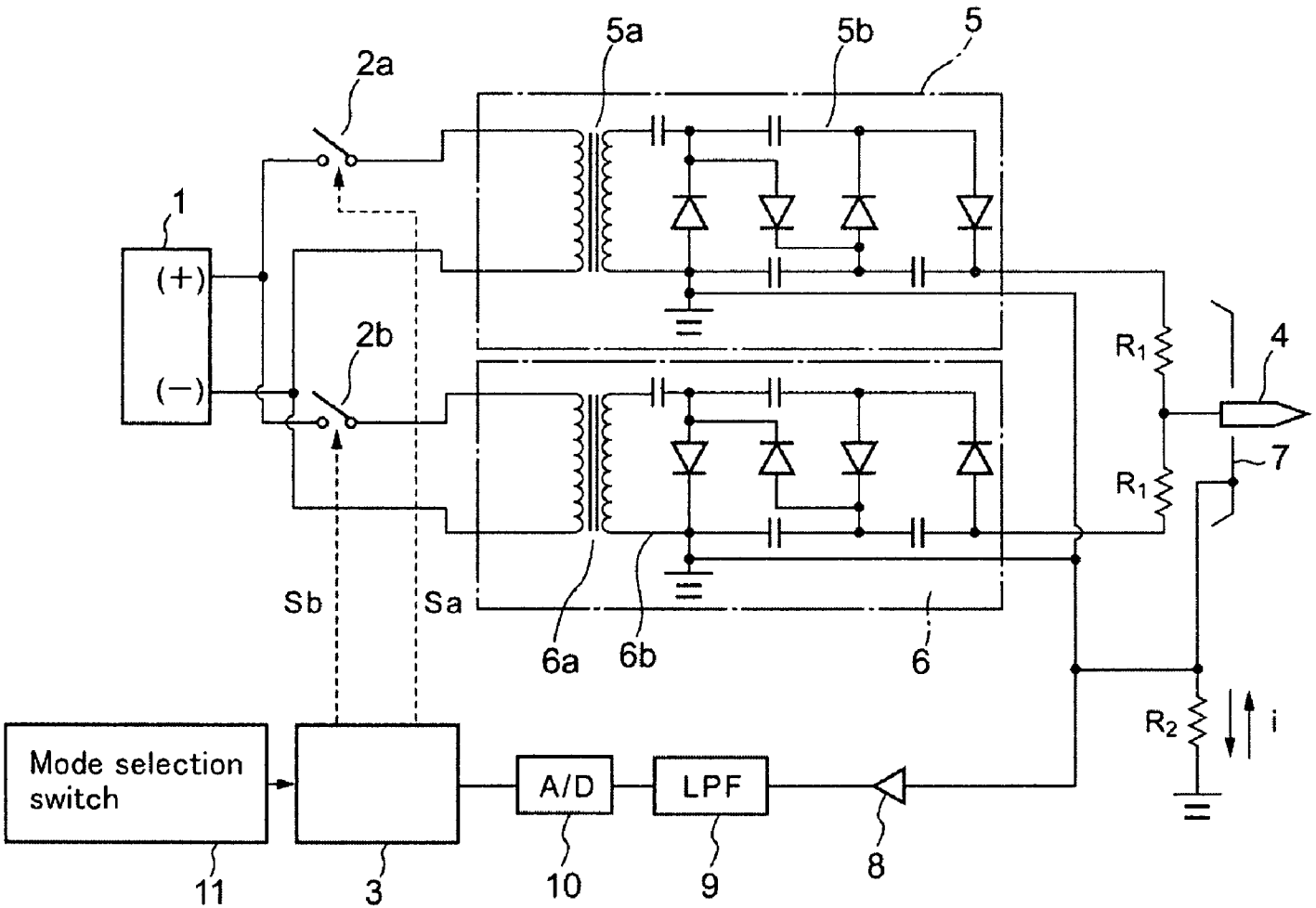
FIG. 1 shows a circuit diagram of an electricity removal apparatus according to an embodiment.

FIG. 1 is a circuit diagram of an electricity removal apparatus, namely an ionizer, according to one embodiment. In FIG. 1, numeral 1 represents a direct-current power supply, and constituted from an external direct-current power supply such as a secondary battery. Numeral 2*a* and numeral 2*b* respectively represent a first switch and a second switch provided on an output side of the direct-current power supply 1. The first switch 2*a* and the second switch 2*b* are controlled to open and close by control signals Sa and Sb from a control unit 3. Of course, electronic switches such as transistors can be used as the first switch 2*a* and the second switch 2*b*.

A positive terminal of the direct-current power supply 1 is connected via the first switch 2*a* with a first high voltage producing circuit 5 having a positive polarity including a transformer 5*a* and a voltage doubler rectifier circuit 5*b*. On the other hand, a negative terminal of the direct-current power supply 1 is connected via the second switch 2*b* with a second high voltage producing circuit 6 having a negative polarity including a transformer 6*a* and a voltage doubler rectifier circuit 6*b*.

The high voltage producing circuits 5 and 6 are connected to an electrode needle 4 respectively via resistances R1 and R1 that are equivalent and serve as impedance for current limit. Then, the electrode needle 4 is grounded via a second resistance R2.

By opening and closing the first switch 2*a* and the second switch 2*b* alternately with the control signals Sa and Sb outputted from the control unit 3, negative or positive high voltages in a pulse shape are alternately supplied to the electrode needle 4 at a predetermined frequency from the first high voltage producing circuit 5 and the second high voltage producing circuit 6. With this, positive or negative ions are alternately produced from the electrode needle 4.

Controlling of the electricity removal apparatus includes an electricity removal mode and a halt mode. In the electricity removal mode, the electricity is positively removed from a charged body by producing ions by applying a high voltage on the electrode needle 4, that is, the electrode needle 4 is applied with a voltage that can ionize an ambient gas around the electrode needle 4. In the halt mode, ions are not positively produced by halting the application of the high voltage on the electrode needle 4, that is, the electrode needle 4 is substantially brought to a halt state by applying no voltage or a voltage that alone cannot ionize the ambient gas around the electrode needle 4. The electricity removal mode and the halt mode are selectively set by a mode selection switch 11 operable by a user (FIG. 1).

In the mean time, when operating in the halt mode, when a charged body having a potential difference with the electrode needle 4 that can self discharge emerges from the electrode needle 4, a charge having an opposite polarity from the charged body is induced at a tip end of the electrode needle 4. With this, a self discharge phenomenon occurs. The occurrence of the self discharge can be known by a signal produced in an internal circuit of the electricity removal apparatus. Specifically, there is a method in which, in order to directly or indirectly detect the current that flows through the electrode needle 4 in the self discharge, a resistance is provided either between the electrode needle 4 and the ground, or between the high voltage producing circuits 5 and 6 and the electrode needle 4, and by detecting a value of the current flowing through the resistance, it is determined that the self discharge has occurred if the value of the current is equal to or greater than a threshold value. Specifically, examples include (1) a resistance is interposed in order to detect a self discharge detection current that flows between the high voltage power source and the ground, and the self discharge is detected indirectly, on the basis of the value of the current that flows through this resistance, (2) a resistance is interposed in order to detect the self discharge detection current between an opposite electrode and the ground, and the self discharge is detected directly, on the basis of the value of the current that flows through this resistance, (3) a combination of (1) and (2), that is, a resistance is interposed in order to detect a self discharge detection current that flows between the high voltage power source and the ground, and the resistance R2 is interposed in order to detect the self discharge detection current between an opposite electrode and the ground, and thus the self discharge is detected (FIG. 1), and (4) the resistance R2 is provided between the electrode needle and the high voltage power source, and the self discharge is detected directly, on the basis of the value of the self discharge detection current that flows through this resistance (FIG. 2).

When one of the above explained self discharge detection units (1) to (3), that is, a self discharge detection circuit that detects the value of the current that flows with the ground is employed, it is possible to use this circuit also as a detection unit for detecting an ion balance in the electricity removal at least in the electricity removal mode. Specifically, if a duty ratio between a negative period and a positive period of the electricity removal is set in proper, the total value of the current flowing through each resistance in a cycle would be zero. When it is recognized that the duty ratio is appropriate based on each value of the current flowing through each resistance, a duty ratio, which is similar to the set duty ratio, is employed for the succeeding cycle. On the other hand, if the electricity removal based on a duty ratio between negative and positive that are currently set is not appropriate, the value of the total current that flows through the resistances in this cycle is biased to positive or negative, and a duty ratio derived by correcting the current duty ratio to perform a more appropriate electricity removal is employed based on this value in the succeeding cycle. Therefore, the electricity removal apparatus is controlled so that the circuit shown in FIG. 1 uses data for values of the current supplied from the resistance R2 in the electricity removal mode and in the halt mode according to a signal from the mode selection switch 3. Of course, in the halt mode, the ion balance control may be performed using the value of the current that flows through the resistance R2 when applying a high voltage on the electrode needle 4 for the electricity removal.

Figure 2:
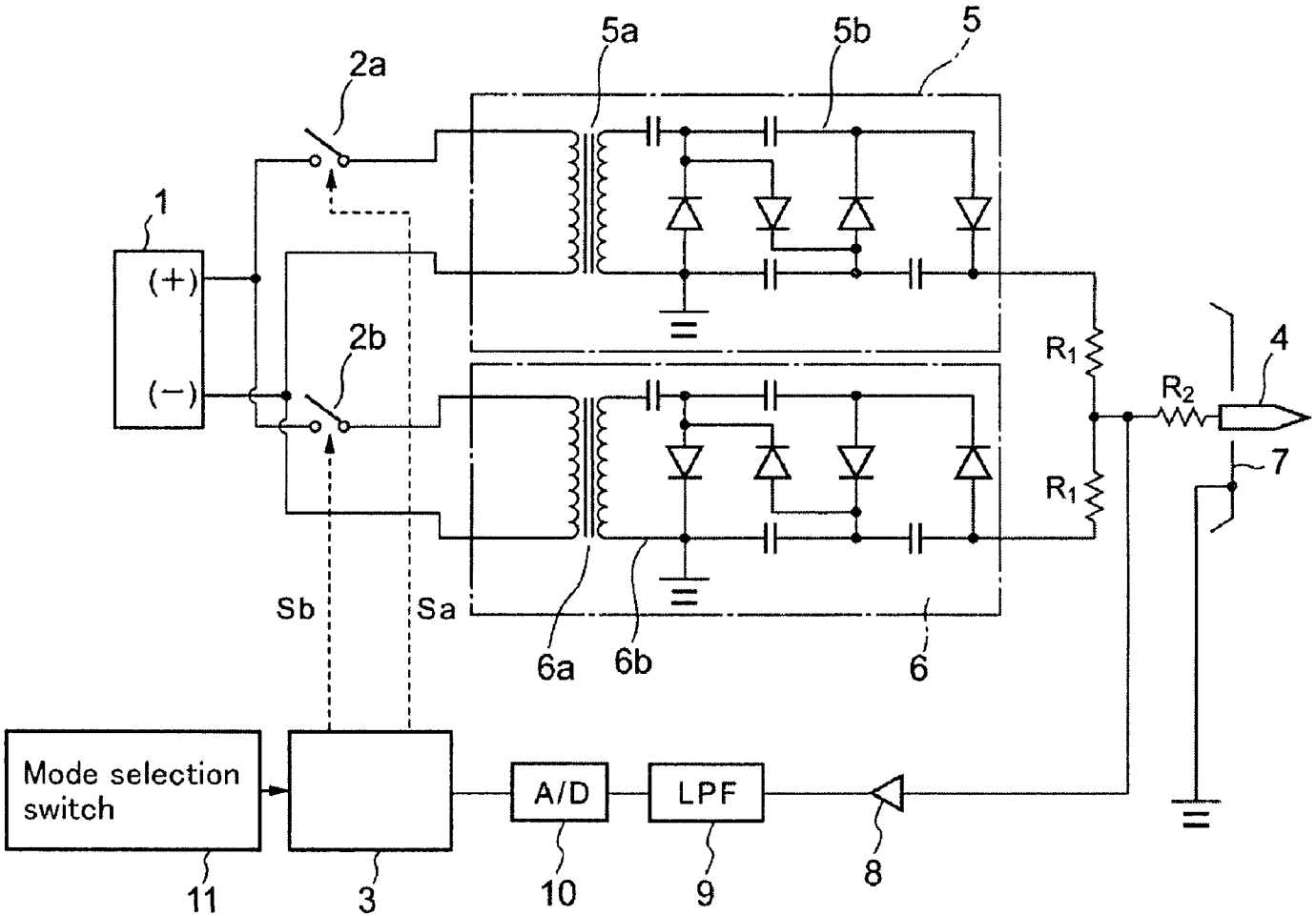
FIG. 2 shows an example of a modified circuit diagram of the electricity removal apparatus according to the embodiment.

The self discharge detection current that flows through the circuit regarding the self discharge is supplied to the control unit 3, as shown in FIG. 1 and FIG. 2, via an amplifier 8, a low pass filter (LPF) 9, and an analog/digital converter (A/F) 10.

Figure 3:
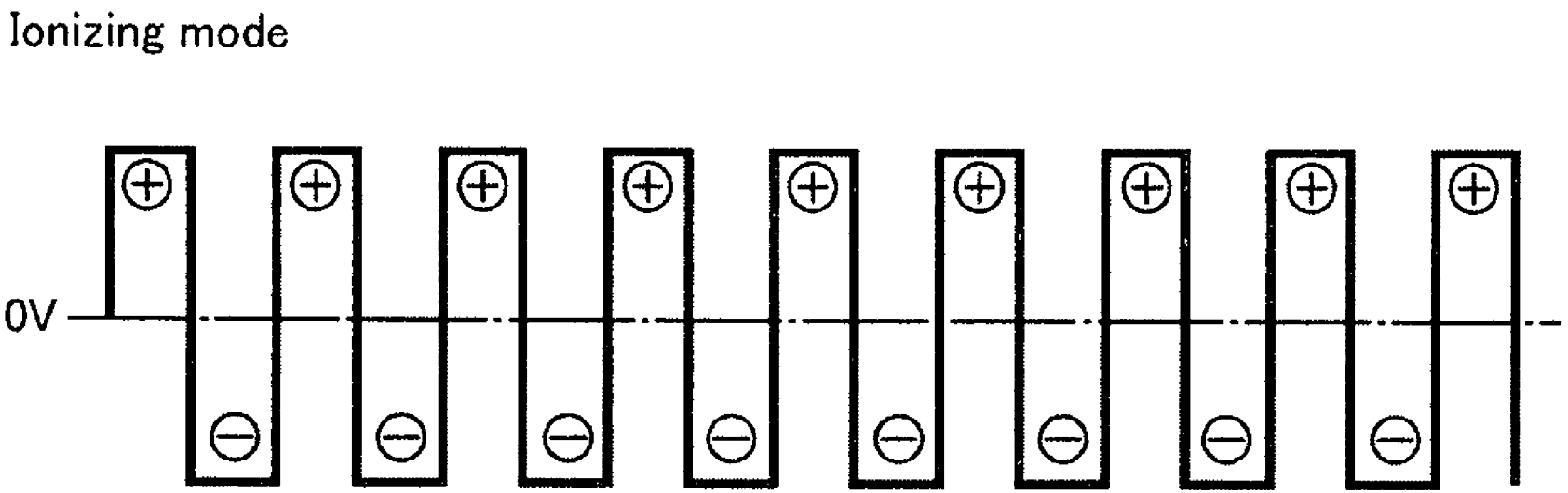
FIG. 3 shows an illustration of one example of a method for applying high voltage in an electricity removal mode in the electricity removal apparatus for which the electricity removal mode and a halt mode are selectively settable.
Figure 4:
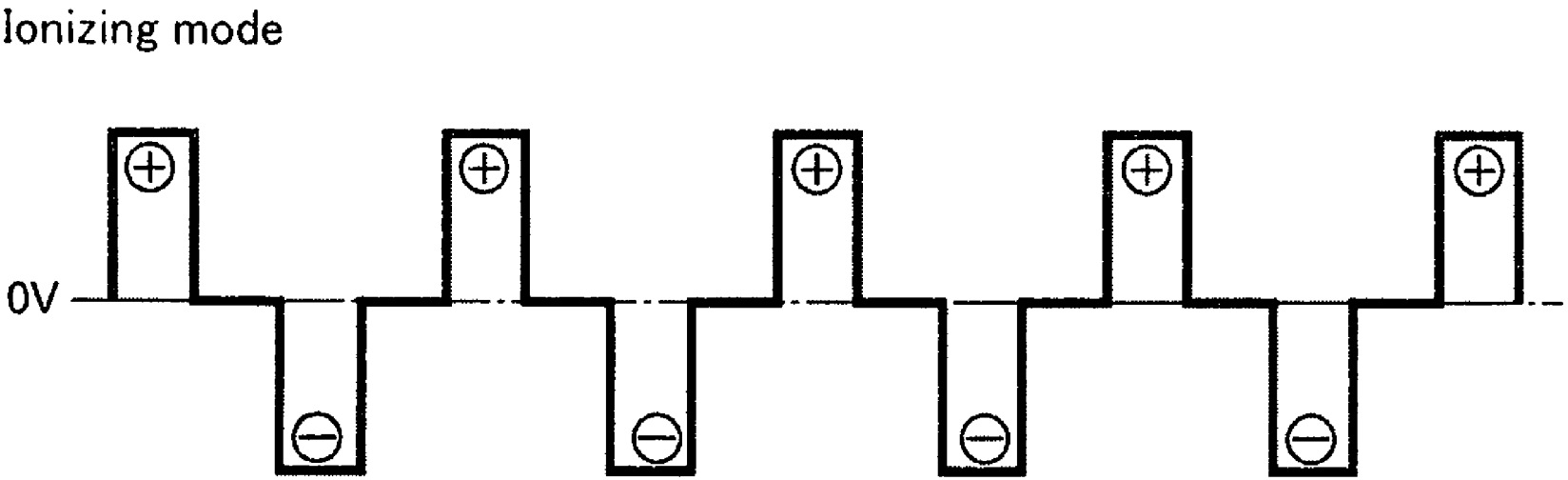
FIG. 4 shows an illustration of another example of a method for applying high voltage in an electricity removal mode in the electricity removal apparatus for which the electricity removal mode and the halt mode are selectively settable.
Figure 5:
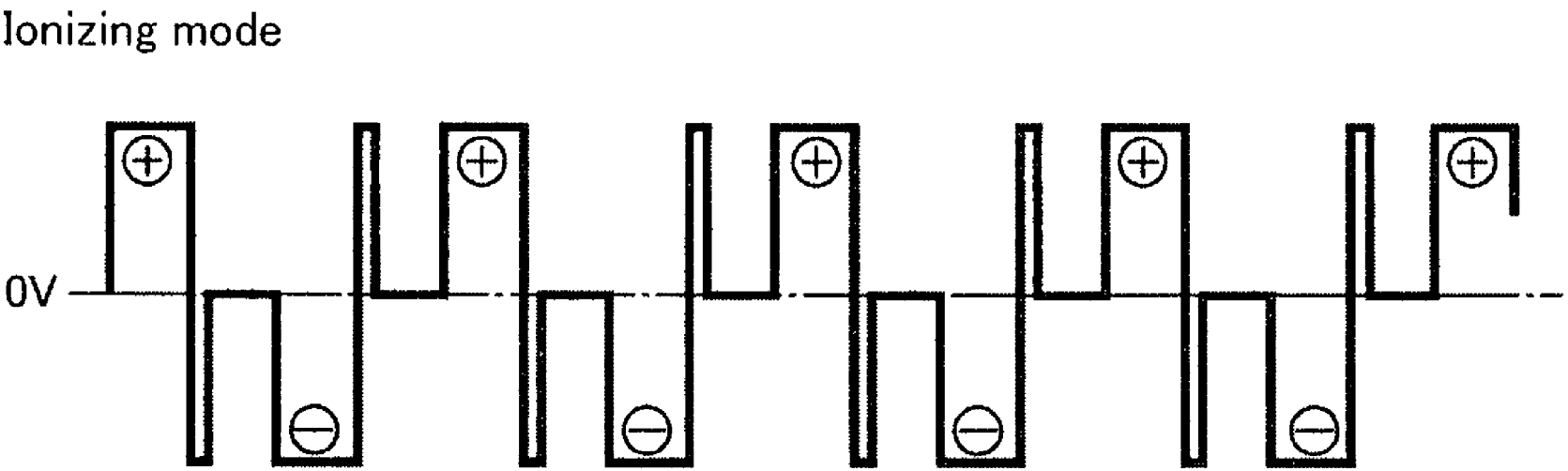
FIG. 5 shows an illustration of yet another example of a method for applying high voltage in an electricity removal mode in the electricity removal apparatus for which the electricity removal mode and the halt mode are selectively settable.

In the electricity removal mode, as shown in FIG. 3, high voltages in a pulse shape that have opposite polarities are alternately and successively applied on the electrode needle 4. FIG. 4 and FIG. 5 show modified examples of the operation in the electricity removal mode. As shown in FIG. 4, an interval during which a high voltage is not applied can be inserted at timings at which high voltages on a positive side and a succeeding negative side and on a negative side and a succeeding positive side are applied so as to extend the life duration of the electrode needle 4. Another modified example is possible, as shown in FIG. 5, in which positive ions are produced by applying a high voltage on the positive side, then, a high voltage on the negative side is applied on the electrode needle 4 for a short period of time, and subsequently, after an interval, negative ions are produced by applying a high voltage on the negative side in the same manner, then, a high voltage of an opposite polarity (positive side) is applied on the electrode needle 4 for a short period of time, and subsequently, after an interval, positive ions are produced by applying a high voltage on the positive side. According to a method of application of high voltage in the another modified example as shown in FIG. 5, it is possible to neutralize the positive voltage that remains in a high voltage application path toward the electrode needle 4 by producing positive ions and then applying a voltage having an opposite polarity is applied on the electrode needle 4 for a short period of time. Moreover, it is possible to reduce an amount of contamination attached to the electrode needle 4 over time by applying such a voltage for neutralization on the electrode needle 4.

Of course, in order to control a balance between positive and negative ions produced by the application of high voltages on the electrode needle 4, when the ion balance is on the negative side, for example, by performing a duty control to relatively increase a pulse width of a positive high voltage, it is possible to maintain the ion balance of an atmosphere around the electrode needle 4. Japanese Unexamined Patent Publication No. 2003-86393, for example, describes the ion balance control in detail, and the disclosure of this publication is incorporated herein in its entirety. In this embodiment, in the electricity removal mode, a duty ratio where a high voltage having a positive polarity and a high voltage having a negative polarity are applied on the electrode needle 4 is determined based on one or more duty ratios that have been performed previously.

In the halt mode, a voltage is basically not applied on the electrode needle 4. Then, the electricity removal operation is initiated when an occurrence of the self discharge in the halt period during which a voltage is not applied is detected by a value of the current that flows through the second resistance R2 in the internal circuit of the electricity removal apparatus. Then, when the time period has passed or the electricity removal of the charged body is completed, the operation returns to the halt period. That is, the application of a voltage on the electrode needle 4 is basically suspended in the halt mode, and only when the emergence of the charged body is detected in an area for the electricity removal, the electricity removal operation is performed. Then, an intrusion of the charged body into the area for the electricity removal is detected by the internal circuit of the electricity removal apparatus.

Figure 6A:
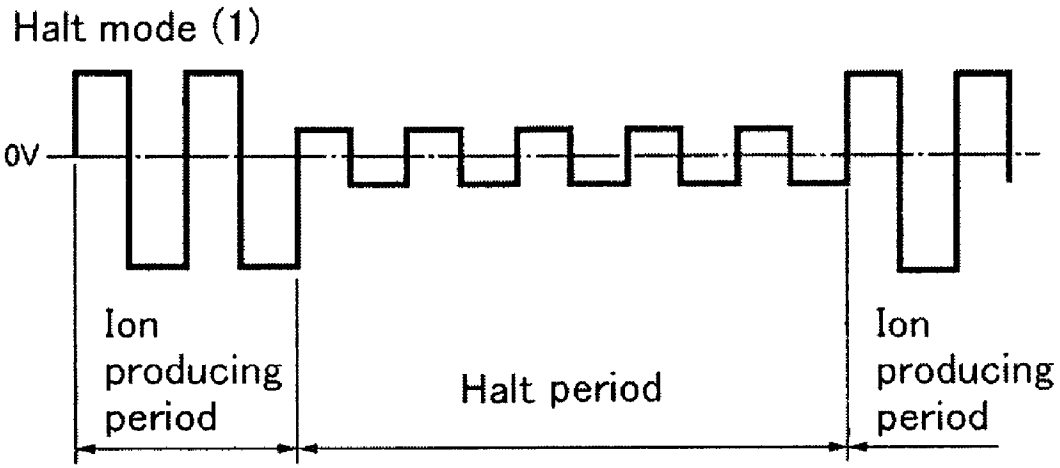
FIGS. 6A and 6B show examples of a control mode in the halt mode including a halt period and an ion producing period.

The following describes the electricity removal mode in detail. FIG. 6 and FIG. 7 show examples of a control in the halt mode. FIG. 6A shows a halt mode (1) as a first example, and FIG. 6B shows a halt mode (2) as a second example, FIG. 7A shows a halt mode (3) as a third example, and FIG. 7B shows a halt mode (4) as a fourth example.

Figure 6B:
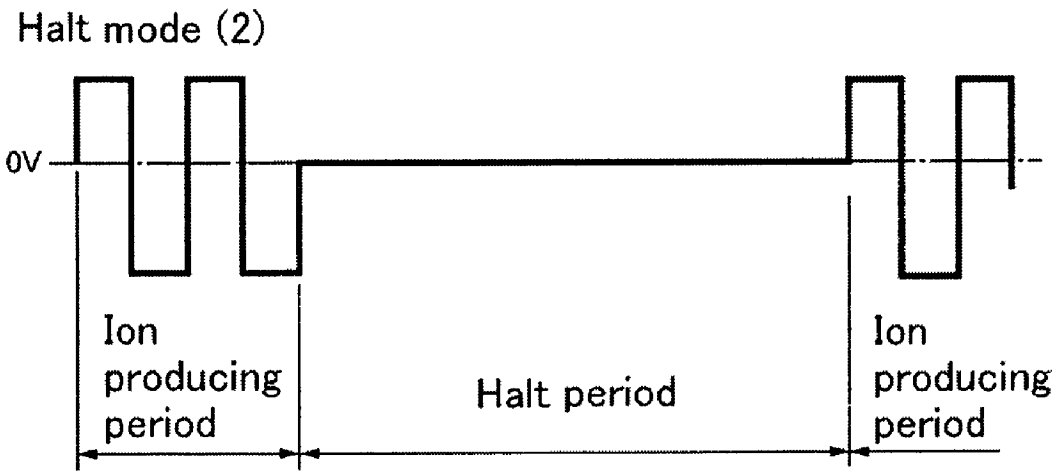

The control modes in the halt modes (1) and (2) shown in FIG. 6A and FIG. 6B include, in addition to the halt period that is a predetermined period and in which ions are not produced, predetermined periods before and after the halt period, and an ion producing period in which ions are produced by an application of a high voltage on the electrode needle 4. As a method for setting the predetermined periods with respect to the halt period, periods that are specific to the electricity removal apparatus can be set, or the user may arbitrarily set based on a number of pulses or time. As a method for setting the predetermined periods with respect to the ion producing period, periods that are specific to the electricity removal apparatus can be set, or the user may arbitrarily set based on a number of pulses or time.

The control modes in the halt modes (3) and (4) shown in FIG. 7A and FIG. 7B only include a halt period. Therefore, the halt period, in the control modes in the halt modes (3) and (4), does not includes the predetermined periods, and the halt period continues unless the electricity removal is initiated by detecting a charged body that is charged more than a predetermined value. Moreover, with reference to FIG. 6 and FIG. 7, in the halt period, a voltage that does not produce ions may be applied on the electrode needle 4 as long as a charged body that is charged more than the predetermined value is present in the area for the electricity removal (halt mode (1) in FIG. 6A, and halt mode (3) in FIG. 7A), or any voltage may not be applied on the electrode needle 4 (voltage application is halted) (halt mode (2) in FIG. 6B and halt mode (4) in FIG. 7B).

When the halt modes (1) and (3) shown in FIG. 6A and FIG. 7A are employed, in the halt period, applying a high voltage that is lower than a voltage at which a discharge starts on the electrode needle 4 decreases the potential difference between the electrode needle 4 and the charged body, thereby improving the sensitivity for the charged body that is slightly charged.

When the application of a voltage on the electrode needle 4 during the halt period is halted as in the halt modes (2), (4) shown in FIG. 6B and FIG. 7B, for example, if the minimum value of the voltage applied on the electrode needle 4, that can ionize the atmosphere around the electrode needle 4, is 3 kV, a self discharge would occur from the electrode needle 4 when the potential difference between the electrode needle 4 and the charged body exceeds a threshold value (3 kV, for example) in the halt period. Then, the self discharge can be detected by a circuit (the value of the current that flows through the second resistance) in the electricity removal apparatus, thereby initiating the electricity removal operation. The value of the voltage that is applied on the electrode needle 4 in this electricity removal operation is 5.3 kV, for example.

When a high voltage that is a low value (2 kV, for example) relative to the minimum value of the voltage (3 kV, for example) is applied on the electrode needle 4 during the halt period as in the halt modes (1) and (3) shown in FIG. 6A and FIG. 7A, a self discharge occurs from the electrode needle 4 when the potential difference between the electrode needle 4 and the charged body exceeds a threshold value (1 kV, for example) in the halt period, and the self discharge is detected by the value of the current that flows through the second resistance R2, thereby applying a high voltage that can ionize the atmosphere around the electrode needle 4 (5.3 KV, for example) on the electrode needle 4 (initiation of the electricity removal operation). This electricity removal operation is substantially the same as the operation as described in the electricity removal mode. In this manner, applying a high voltage that is the low value relative to the minimum value in the halt period can increase the sensitivity for detecting the charged body. With this embodiment, without providing an external sensor to detect whether or not the charged body has intruded into the area for the electricity removal (presence of the charged body), the electricity removal operation can be performed using the internal circuit of the electricity removal apparatus only when the charged body is present. In other words, because the state in which the ion production by the electrode needle 4 is stopped can be maintained when the charged body is not present, it is possible to suppress the wear of and attachment of contamination to the electrode needle 4.

Needless to say, the "threshold value" in the control based on FIG. 6 and FIG. 7 as described above is not a "threshold value" that is stored in memory and the like in advance. The "threshold value" is determined based on the potential difference between a) either a voltage applied on the electrode needle 4 in the halt period in the halt mode as shown in FIG. 6 and FIG. 7 or the ground state where a voltage is not applied to the electrode needle 4, and b) the voltage that can ionize the atmosphere around the electrode needle 4. However, when a voltage is not applied on the electrode needle 4 in the halt period in the halt mode, the threshold value can be equal to or greater than 3 KV, and is not necessarily 3 KV. Similarly, in the halt period in the halt mode, when a high voltage of relatively low level is applied, if the value of the voltage to be applied on the electrode needle 4 is 2 KV, then the threshold value can be equal to or greater than 1 KV, and is not necessarily 1 KV. From this, the "threshold value" can be a fixed value to the halt mode for the electricity removal apparatus according to the above logic, or by automatically setting a minimum value as the "threshold value" and a maximum value as the value of the voltage to be applied in the electricity removal mode, a user may set any given value between the minimum and maximum values as the "threshold value" as the user sees fit.

Figure 8:
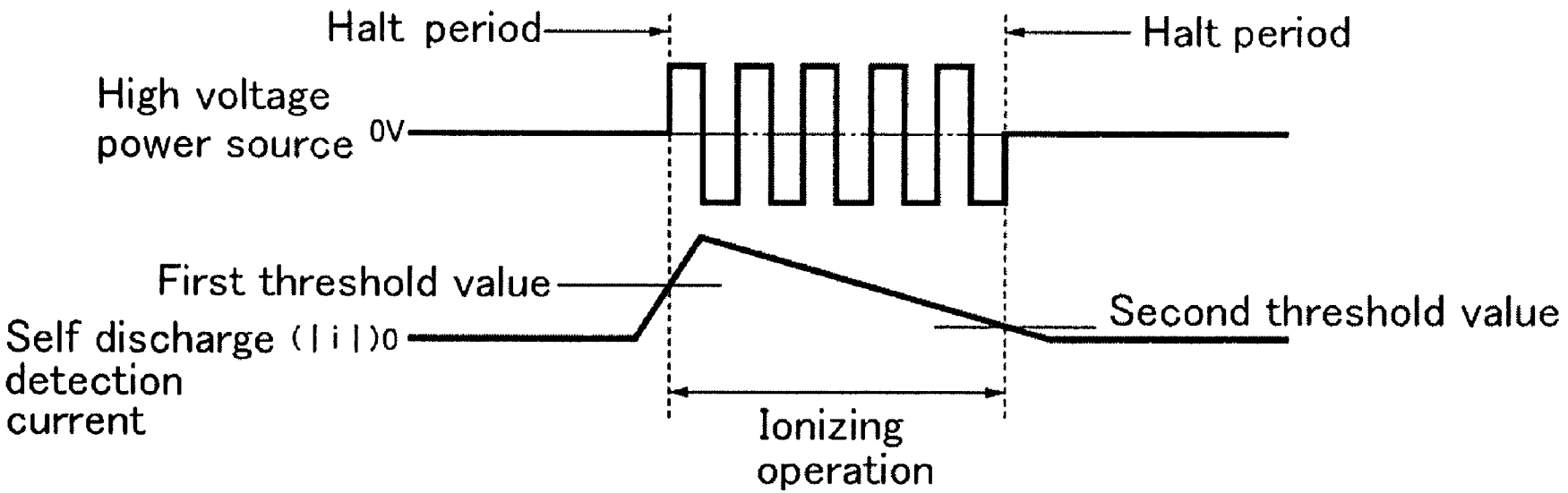
FIG. 8 shows an example of a control for performing an electricity removal operation by applying a high voltage on the electrode needle when a charged body is detected by an internal circuit of the electricity removal apparatus in the halt mode in the same manner as in the electricity removal mode, and shows an example in which the electricity removal operation is initiated and terminated using a threshold value.

As described above, switching to terminate the halt period in the halt mode based on the "threshold value" and start the electricity removal operation, as well as to terminate the electricity removal operation and resume the halt period can be performed based on a value of current i (absolute value amplified by an amplifier 7) that flows through the second resistance R2 (FIG. 1 and FIG. 2). FIG. 8 shows an example of control in the halt period in the halt mode to detect the charged body to perform the electricity removal operation, and to terminate the electricity removal operation to resume the halt period. With reference to FIG. 8, when an absolute value |i| of the self discharge detection current exceeds a first threshold value (for example, a current value corresponding to 3 KV), the halt period is terminated and the electricity removal operation starts. Then, when the electricity removal of the charged body proceeds and the absolute value |i| of the self discharge detection current goes below a second threshold value (for example, a current value corresponding to a value smaller than 1 KV), the electricity removal operation is terminated and the halt period is resumed. In other words, the control example shown in FIG. 8 is an example in which the initiation and termination of the electricity removal operation in the halt mode are both performed using a threshold value.

As a specific electricity removal control performed in the halt mode, a voltage application method may be employed that is the same as one of the various specific voltage application methods performed in the electricity removal mode that are specifically illustrated with reference to FIG. 3 to FIG. 5. Of course, a voltage application method different from the voltage application method that is employed in the electricity removal mode can be employed in the electricity removal operation in the halt mode.

Figure 9:
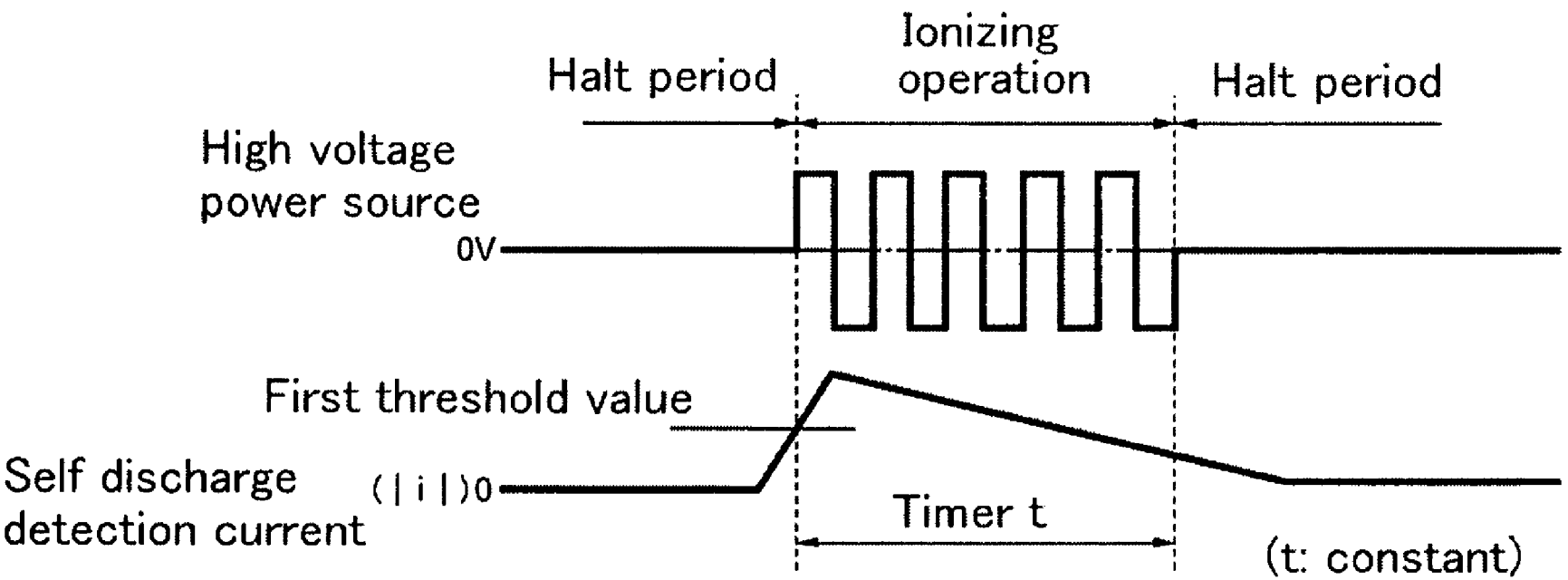
FIG. 9 shows another example for performing the electricity removal operation when the charged body emerges during the halt period in the halt mode, and shows an example in which the electricity removal operation is initiated and terminated using a timer.
Figure 10:
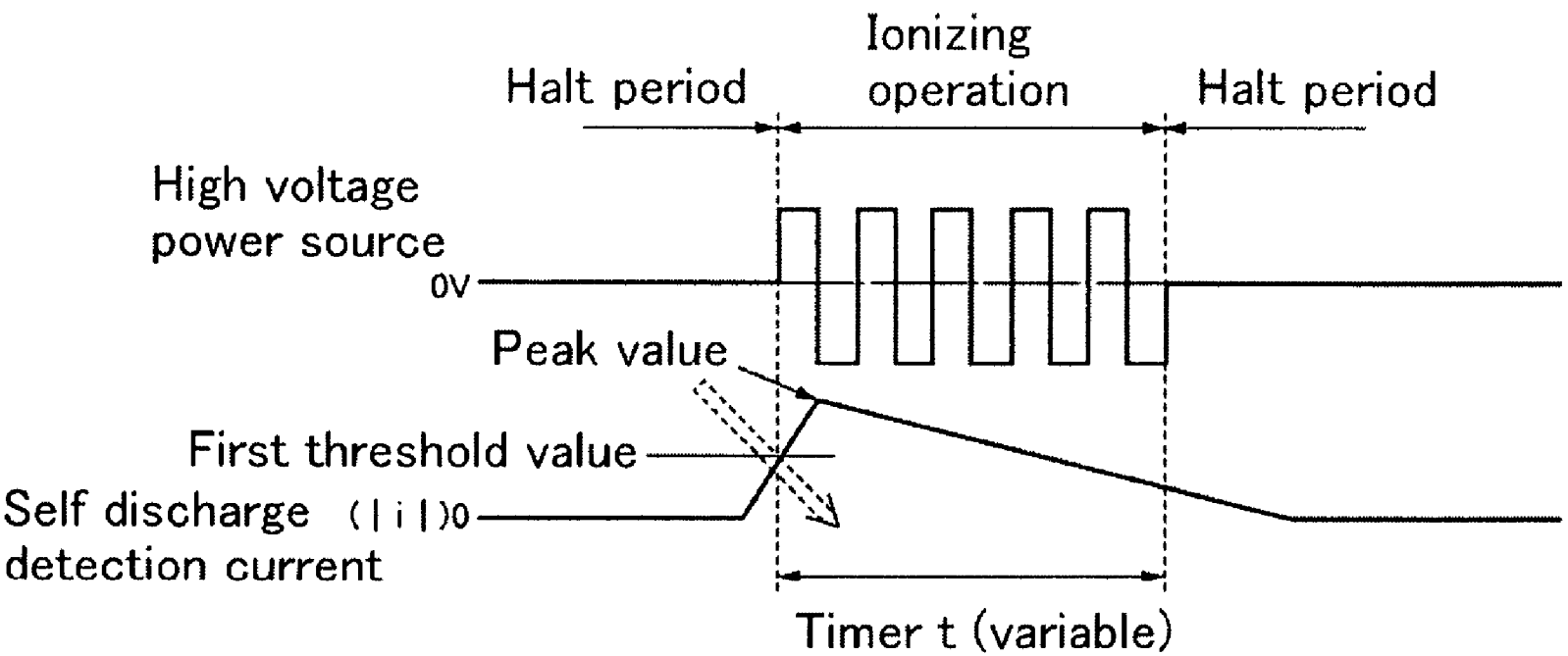
FIG. 10 shows yet another example for performing the electricity removal operation when the charged body emerges during the halt period in the halt mode, and shows an example in which the timer for terminating the electricity removal operation is variably controlled.
Figure 11:
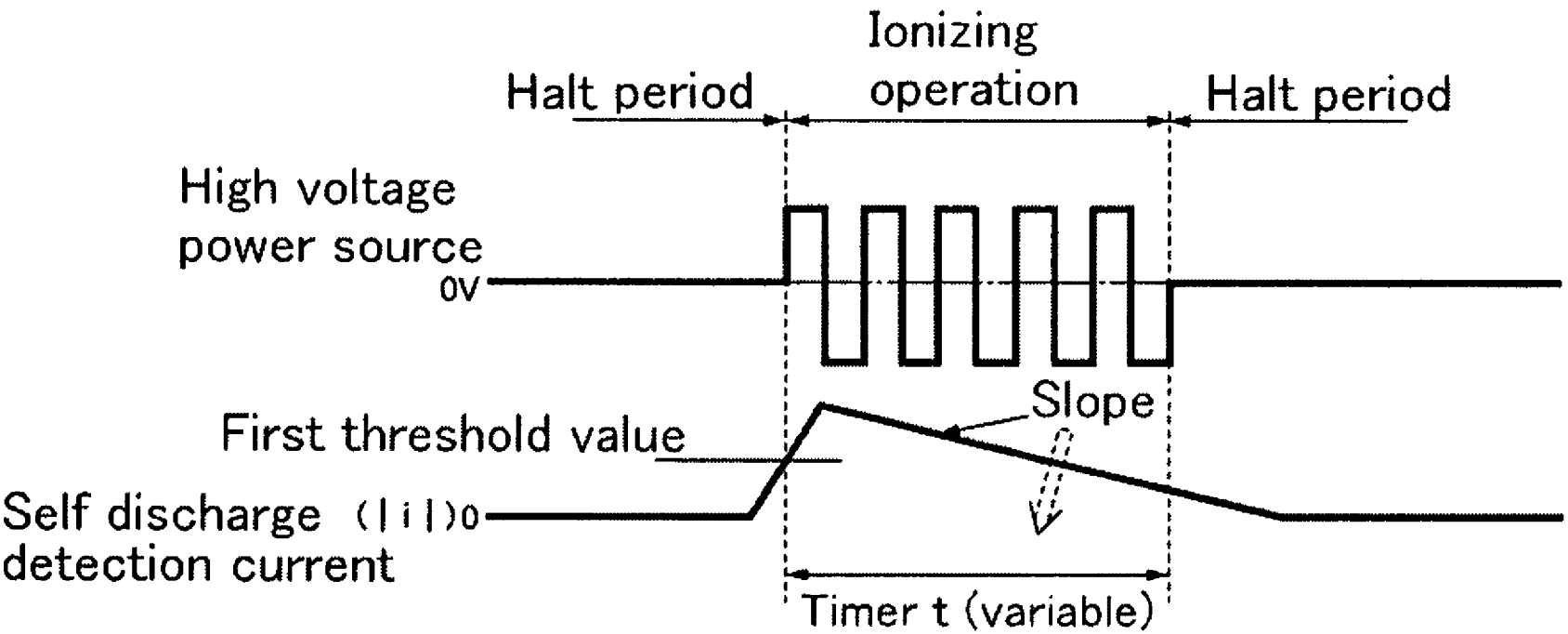
FIG. 11 shows yet another example for performing the electricity removal operation when the charged body emerges during the halt period in the halt mode, and shows another example in which the timer for terminating the electricity removal operation is variably controlled.

In the halt mode, after the halt period is terminated and the electricity removal operation is initiated using the "threshold value", a timer can be used to terminate the electricity removal operation. Specific examples of such a timer are shown in FIG. 9 to FIG. 11. FIG. 9 shows an example in which a time t for the timer is fixed, and the time t can be factory default, or can be arbitrarily set by the user.

FIG. 10 shows an example in which the timer time t is adjusted according to the degree of a peak value of an absolute value of the self discharge detection current. FIG. 11 shows an example in which the timer time t is adjusted according to the degree of a slope representing the value of the self discharge detection current decreasing.

In the adjustment of the timer time t according to the "peak value" as shown in the example of FIG. 10, it is preferable that the timer time t is set to be long when the "peak value" is large, that is, when an amount of charge of the charged body is large, and the timer time t is set to be short when "peak value" is small, that is, when an amount of charge of the charged body is small.

In the adjustment of the timer time t according to the "slope" as shown in the example of FIG. 11, it is preferable that the timer time t is set to be long when the "slope" is small, that is, when an amount of charge of the charged body is gradually decreasing, and the timer time t is set to be short when "slope" is large, that is, when an amount of charge of the charged body is greatly decreasing.

Figure 12:
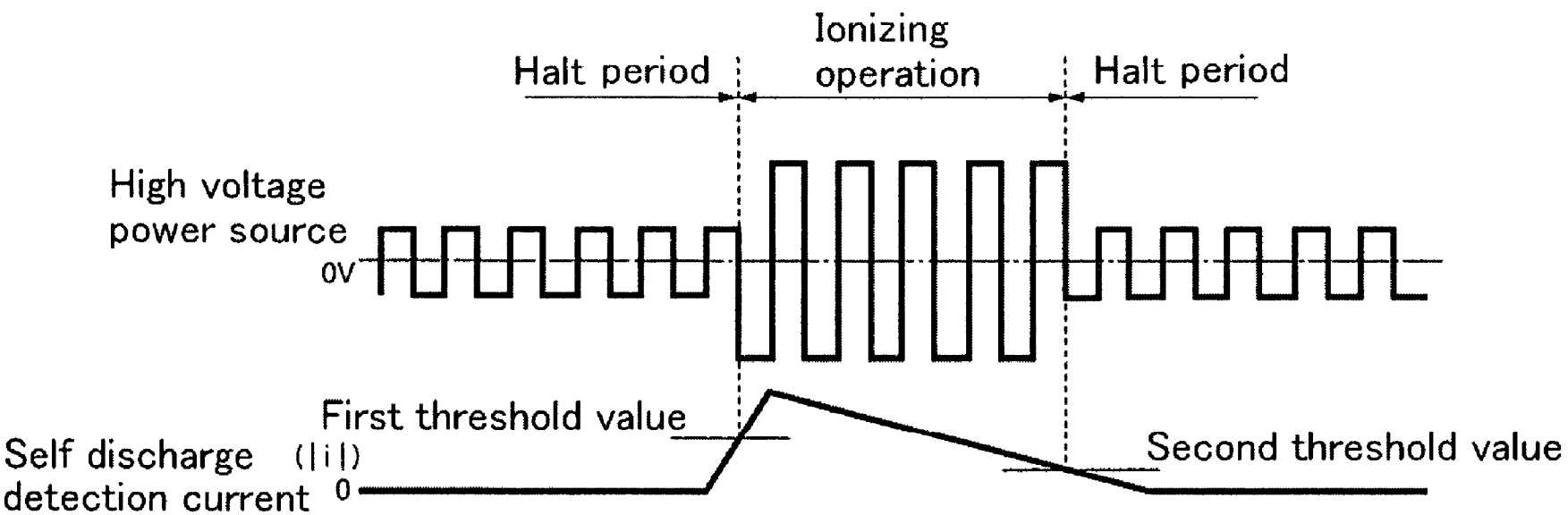
FIG. 12 shows an example in which a low level voltage that does not produce ions is kept applied on the electrode needle during the halt period, in the control for performing the electricity removal operation with the emergence of the charged body.

In FIG. 8 to FIG. 11, as the halt mode, the example in which no voltage is applied on the electrode needle 4 at all (halt mode (4) in FIG. 7) is illustrated. However, it should be understood that the control modes for the halt mode (1) and the halt mode (3) and other control modes that are described later (FIG. 13 and FIG. 14) can also be employed. FIG. 12 shows an example in which the "threshold value" is used for the control to initiate the electricity removal operation by detecting the charged body in the halt mode (1) in FIG. 6A or the halt mode (3) in FIG. 7A in which a relatively low voltage is applied on the electrode needle 4 in the halt period, as well as to terminate the electricity removal operation. However, it should be understood that similar to the examples shown in FIG. 9 to FIG. 11, the termination of the electricity removal operation can be controlled by the timer.

As described above, when the charged body is detected in the halt period by the internal circuit of the electricity removal apparatus, the electricity removal operation in which a high voltage is applied on the electrode needle 4 to positively produce ions is performed. Further, as illustrated in FIG. 6A and FIG. 7A, by including the ion producing period in which a high voltage is applied on the electrode needle 4 intermittently and periodically in the halt mode, the electricity removal of a charged body that is weakly charged can be ensured. Here, in the control modes of the halt modes (1) and (3) illustrated in FIG. 6A and FIG. 7A, a length of the ion producing period and a length of the halt period can be set arbitrarily. Moreover, a time length of a single cycle which is constituted from a combination of ion producing periods and subsequent halt periods and a proportion of the ion producing period and the halt period in the single cycle can be arbitrarily set. For example, the time length of a single cycle, for example, if the electricity removal apparatus is provided for a transfer conveyer with which a work (body whose electricity is to be removed) is carried, the time length that matches to transfer speed of the work may be set.

Figure 13A:
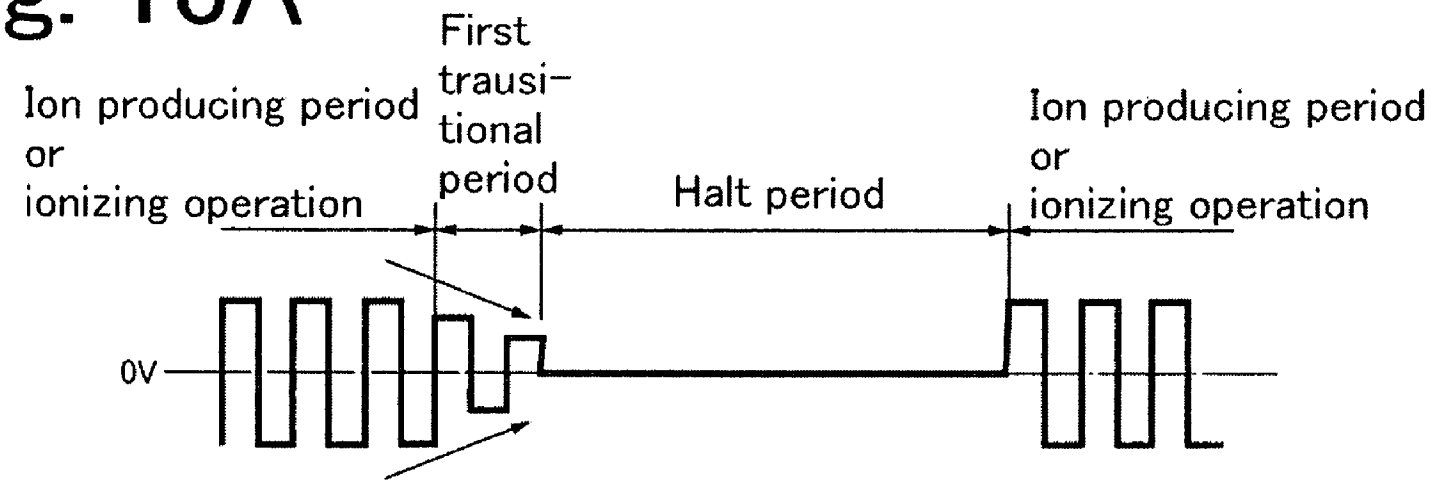
FIGS. 13A and 13B show an example in which a level of the voltage applied on the electrode needle is gradually reduced in a first stage transition provided after the ion producing period or after the electricity removal operation is terminated and before the halt period.
Figure 13B:
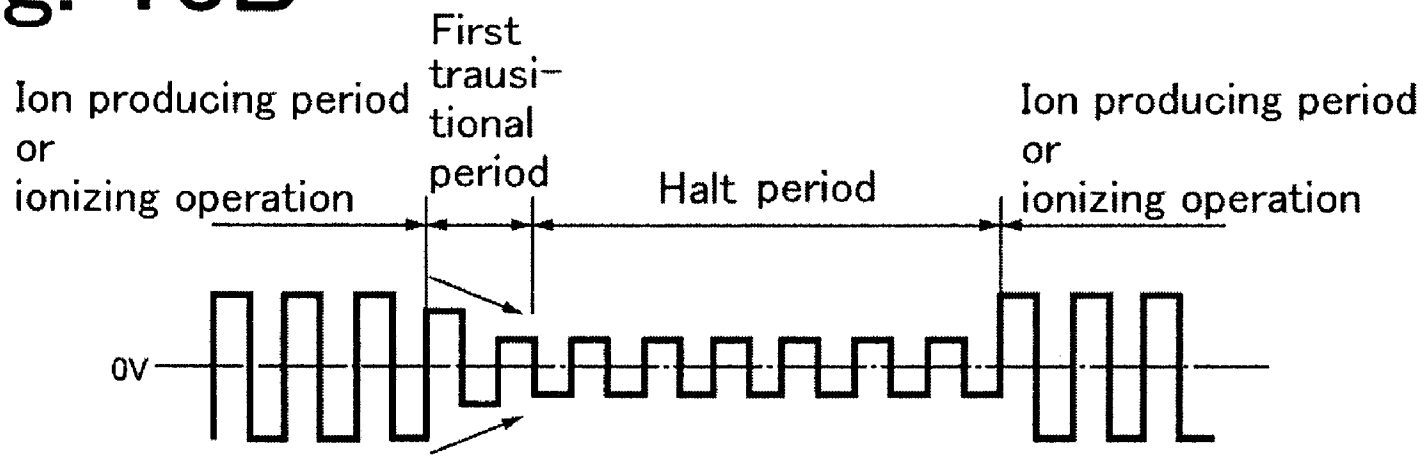

When providing the ion producing period in the halt mode or when the electricity removal operation is performed in the halt period, it is preferable to add a transitional period between ion producing period in which a high voltage is applied on the electrode needle 4 or the electricity removal operation is terminated and the halt period. Specifically, when immediately switched from the ion producing period (or the electricity removal operation) to the halt period, the polarity of the high voltage that is applied on the electrode needle 4 immediately before the halt period, that is, the last of the ion producing period influences on the ion balance in the area for the electricity removal in an early stage in the halt period to cause the ion balance to be unbalanced. Further, the remaining charge that is accumulated in the circuit in the ion producing period (or the electricity removal operation) is applied on the electrode needle 4 in the halt period, and thus the ion production can continue even in the halt period. In order to address this problem, as shown in FIG. 13, a first transitional period is preferably inserted before switching from the ion producing period (or the electricity removal operation) to the halt period to apply a voltage whose absolute value gradually decreases is applied on the electrode needle 4 in the first transitional period. FIG. 13A shows an example of a control mode in the halt mode in which a voltage is not applied on the electrode needle 4 at all in the halt period. FIG. 13B shows an example of a control mode in the halt mode in which a low level voltage is applied on the electrode needle 4 in the halt period.

Figure 14A:
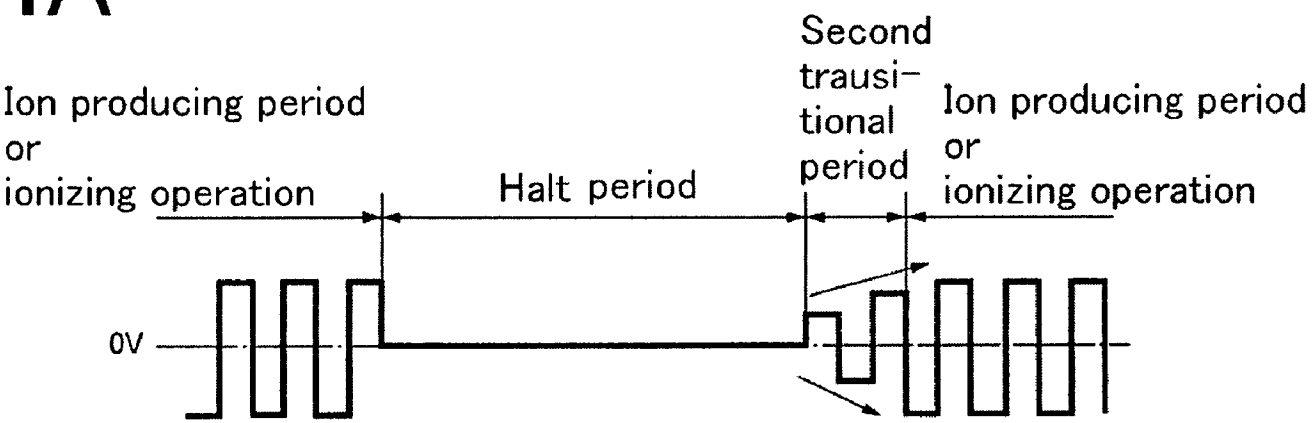
FIGS. 14A and 14B show an example in which a level of the voltage applied on the electrode needle is gradually increased in a second stage transition provided after the halt period and before the ion producing period or electricity removal operation.
Figure 14B:
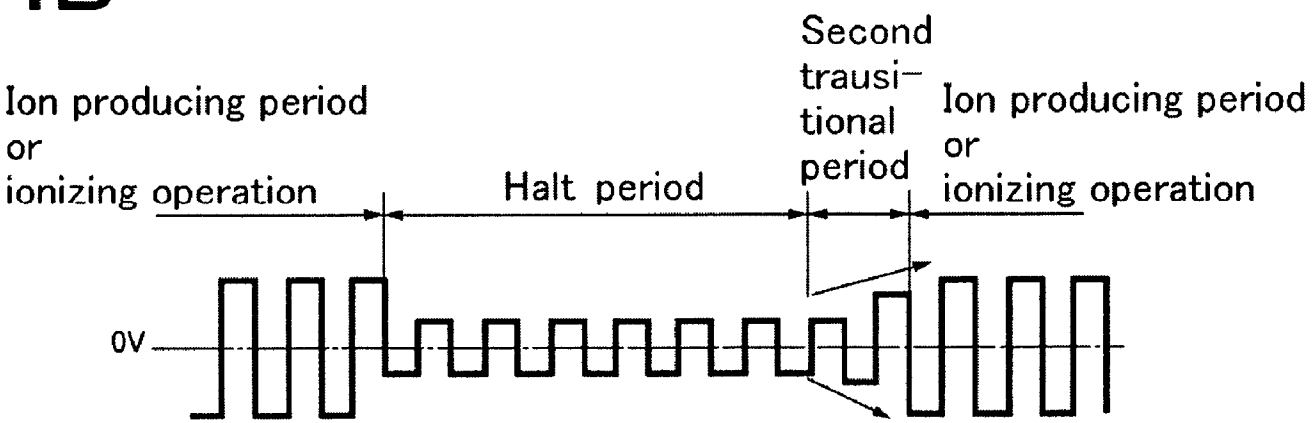

Similarly, it is preferable to add a transitional period in moving from the halt period to the ion producing period or the electricity removal operation. Specifically, when switching immediately to the ion producing period (or the electricity removal operation) from the halt period, a body whose electricity is to be removed is suddenly exposed to ions to charge the body whose electricity is to be removed. As a result, if the body whose electricity is to be removed is a semiconductor, for example, unexpected damage can be caused to the body whose electricity is to be removed, such that a rapid charge may cause what is stored in the memory to be deleted. In order to address this problem, as shown in FIG. 14, it is desirable that a second transitional period is inserted before switching from the halt period to the ion producing period (or the electricity removal operation), and a voltage whose absolute value gradually increases is applied to the electrode needle 4. FIG. 14A shows an example of a control mode in the halt mode in which a voltage is not applied on the electrode needle 4 at all in the halt period. FIG. 14B shows an example of a control mode in the halt mode in which a low level voltage is applied on the electrode needle 4 in the halt period.

Figure 15A:
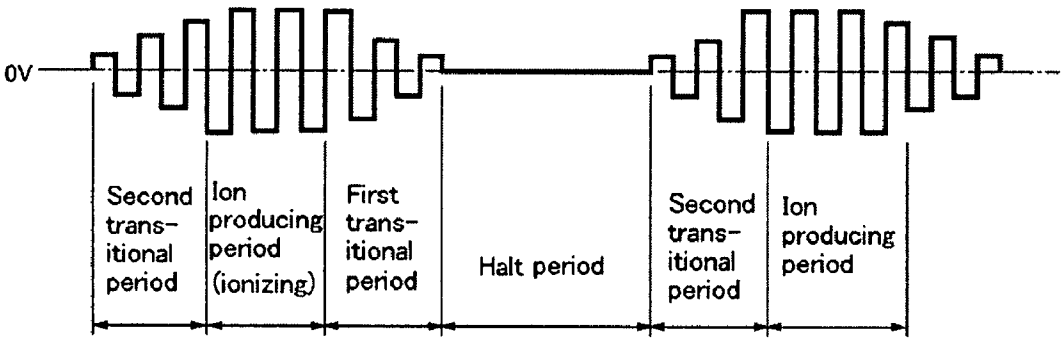
FIGS. 15A and 15B show an example in which a first stage transition provided after the ion producing period or after the electricity removal operation is terminated and before the halt period and a second stage transition provided after the halt period and before the ion producing period or electricity removal operation.
Figure 15B:
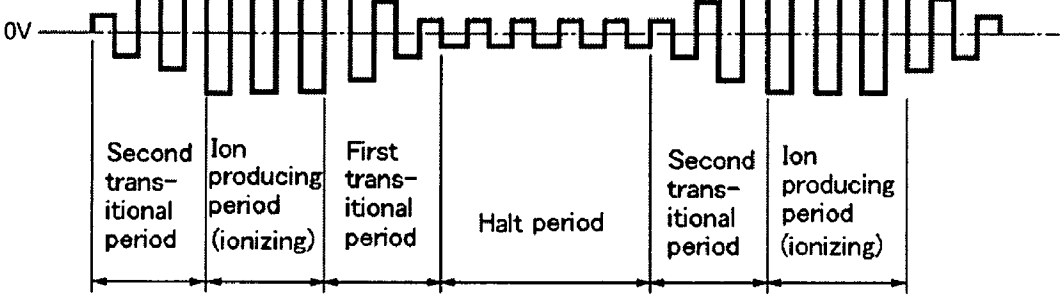

FIG. 15 shows an example as a preferred control example when the ion producing period is provided in the halt mode, in which the first transitional period is inserted immediately before switching from the ion producing period (or the electricity removal operation) to the halt period, and the second transitional period is inserted immediately before switching from the halt period to the ion producing period (or the electricity removal operation). FIG. 15A shows an example of a control mode in the halt mode in which a voltage is not applied on the electrode needle 4 at all in the halt period. FIG. 15B shows an example of a control mode in the halt mode in which a low level voltage is applied on the electrode needle 4 in the halt period.

Figure 16:
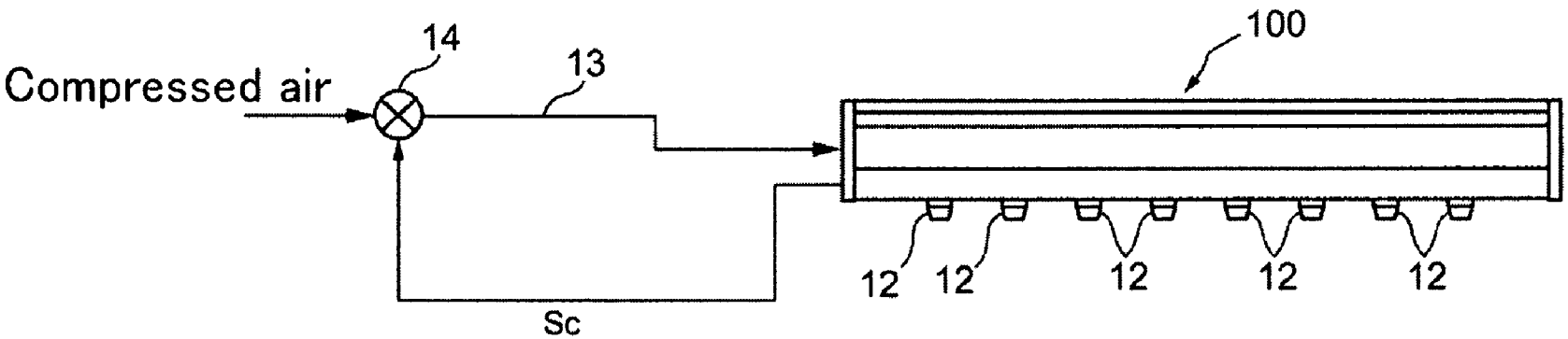
FIG. 16 shows the electricity removal apparatus of the embodiment provided with an on-off valve or an opening adjusting valve between external piping for supplying compressed air, by supplying an output signal generated by an internal signal used for controlling the electricity removal apparatus to the on-off valve or the opening adjusting valve to control the compressed air to be supplied to the electricity removal apparatus.

In order to effectively transfer ions produced by an application of the high voltage on the electrode needle 4 to the body whose electricity is to be removed (charged body), it is a common practice that the ions are blown to the electricity removal apparatus. FIG. 16 shows an electricity removal apparatus 100. The electricity removal apparatus 100 has a plurality of electrode units 12 including the above described electrode needle 4 which are provided with an interval, and the electricity removal apparatus 100 is supplied with filtrated compressed air and an inert gas such as nitrogen via external piping 13. The compressed air and inert gas entering the electricity removal apparatus 100 are discharged via each of the electrode unit 12.

Figure 17:
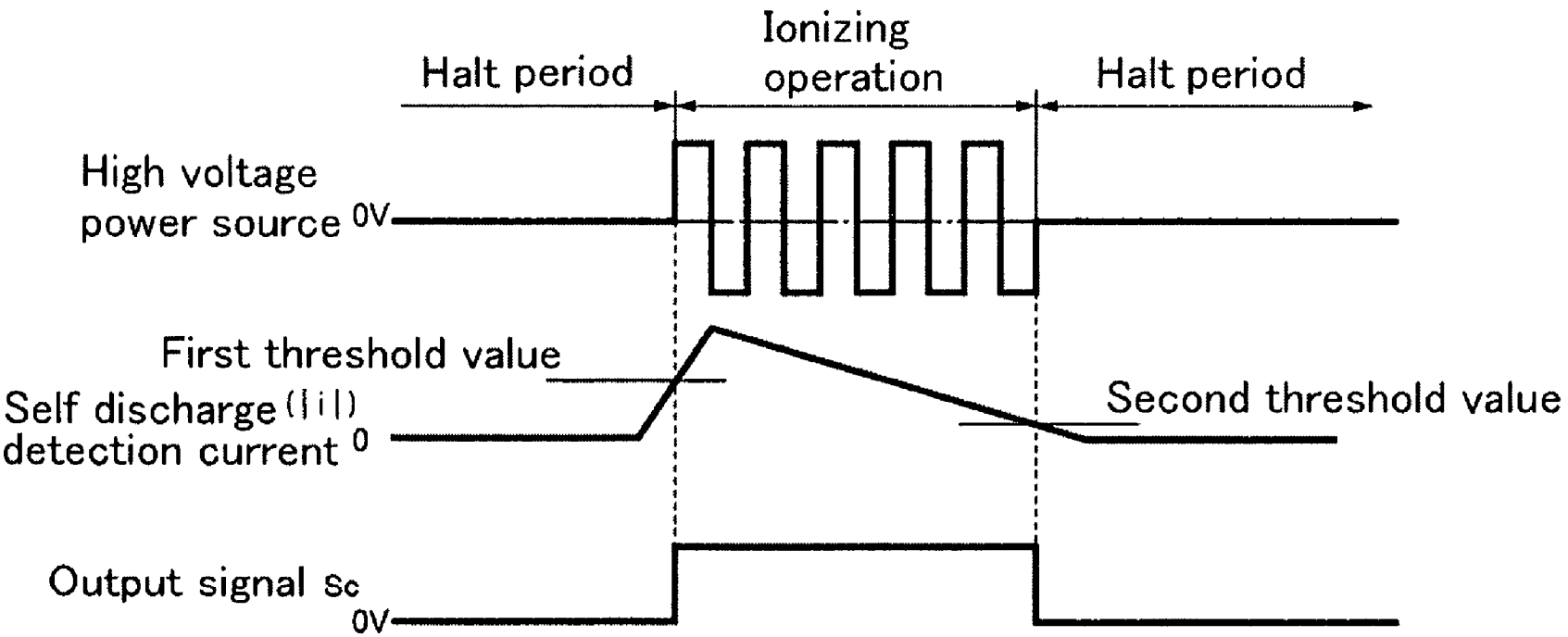
FIG. 17 shows a diagram for illustrating an example in which in order to initiate or terminate the electricity removal operation with an emergence of the charged body in the halt period, the internal signal is generated within the electricity removal apparatus in synch with the initiation and termination.

The external piping 13 has an electromagnetic on-off valve or electrical opening adjusting valve 14 interposed therein, and an opening of the on-off valve or opening adjusting valve 14 is controlled by an output signal Sc from the electricity removal apparatus 100. An example of controlling the on-off valve or opening adjusting valve 14 is explained with reference to FIG. 17. In the example shown in FIG. 17, as is clear from the drawing, the application of a voltage on the electrode needle 4 is terminated in the halt period. When the absolute value of the self discharge detection current i becomes greater than the first threshold value, the operation is switched to the electricity removal operation and the application of a high voltage on the electrode needle 4 is initiated. At the same time, the absolute value of the self discharge detection current i becomes greater than the first threshold value, the output signal Sc is outputted from the electricity removal apparatus 100 to open the electromagnetic on-off valve 14. With this, in synch with the switching to the electricity removal mode, supplying compressed air or an inert gas to the electricity removal apparatus 100 is initiated. On the other hand, when the absolute value of the self discharge detection current i becomes smaller than the second threshold value, the electricity removal operation is terminated and the halt period is resumed, and in sync with this the on-off valve 14 is closed to stop the supply of the compressed air or the inert gas to the electricity removal apparatus 100.

As described above, by outputting a trigger signal that controls to switch between the ion producing period or the electricity removal operation and the halt period in the halt mode, based on the absolute value of the self discharge detection current i or a control signal based on the trigger signal, for example, to control an amount of gas flow supplied to the electricity removal apparatus 100 based on the output signal Sc, it is possible to make the consumption of the compressed air or inert gas reasonable. When a low level voltage is applied on the electrode needle 4 in the halt period, in sync with the transition to the halt period, it is preferable that the opening of the opening adjusting valve 14 is made smaller by the output signal Sc and that an amount of supply of the compressed air or inert gas to the electricity removal apparatus 100 is reduced.

Further, in a case where the halt mode includes the ion producing period and the halt period as explained for instance in FIG. 6, in order to switch from the ion producing period to the halt period, and from the halt period to the ion producing period, a signal generated in the electricity removal apparatus 100 or a control signal base on this signal may be supplied from the electricity removal apparatus 100 as the output signal Sc to the on-off valve or opening adjusting valve 14. In this case, as shown in FIG. 6B and FIG. 7B, when a voltage is not applied on the electrode needle 4 at all in the halt period, it is preferable that the on-off valve 14 is closed to stop the supply of the compressed air or inert gas to the electricity removal apparatus 100. As shown for instance in FIG. 6A, when a low level voltage is applied on the electrode needle 4 in the halt period, it is preferable that a signal to make the opening of the opening adjusting valve 14 smaller is supplied from the electricity removal apparatus 100. The output signal Sc from the electricity removal apparatus 100 may be used to display a current operation state of the electricity removal apparatus 100. Specifically, when displaying that the electricity removal apparatus 100 is currently performing the ion producing period or the halt period, or in operation in the electricity removal mode by an indicator (not shown) provided for the electricity removal apparatus 100 or in the vicinity thereof, lighting on and off of the indicator can be controlled according to the output signal Sc based on the internal signal used to control the electricity removal apparatus 100.

Figure 18:
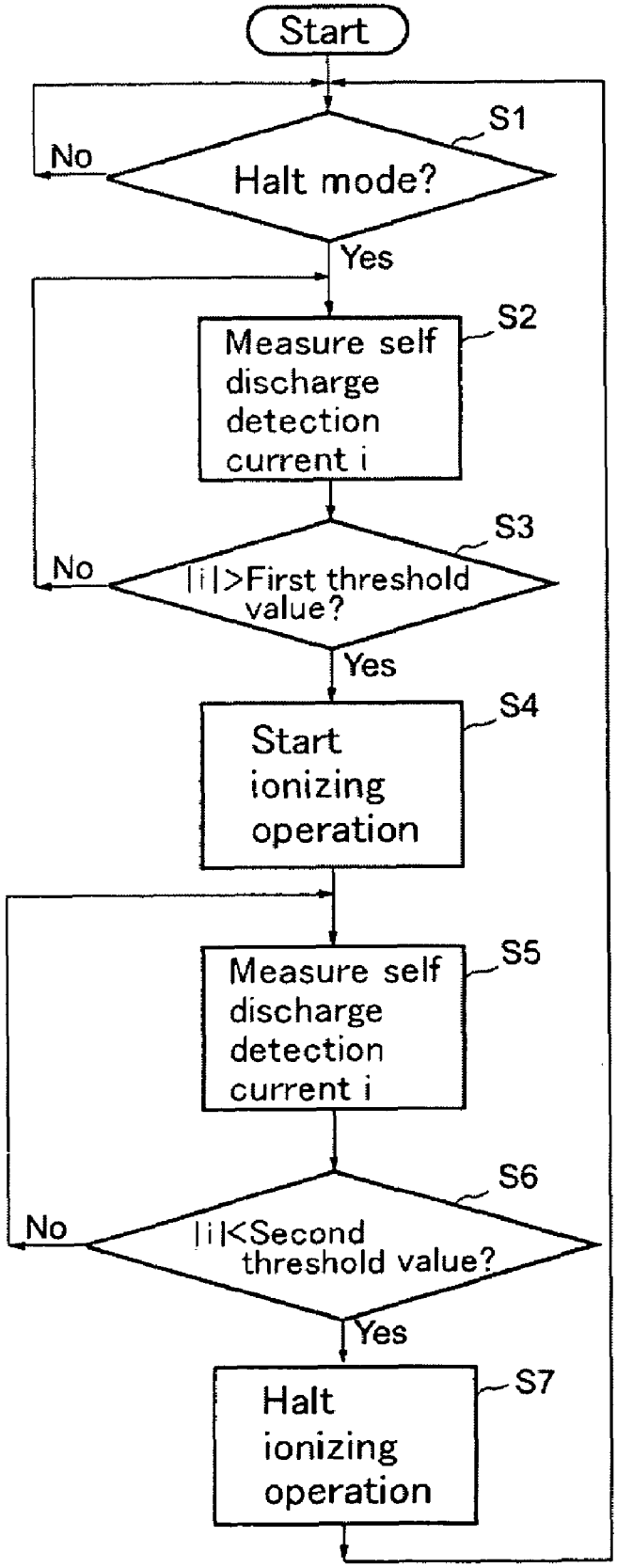
FIG. 18 shows a flowchart of a control example shown in FIG. 8, in which the electricity removal operation is performed when the charged body is detected by an internal circuit of the electricity removal apparatus during the halt period in the halt mode, and that the electricity removal operation is initiated using and terminated a threshold value.

Specific control examples are described with reference to flowcharts shown in FIG. 18 to FIG. 21. FIG. 18 is the flowchart regarding the control of the electricity removal operation in the halt mode based on the above described "threshold value" in FIG. 8. With reference to the flowchart in FIG. 18, in Step S1, whether or not the halt mode is set is determined, and if YES (halt mode is set), the operation precedes to Step S2 to measure the self discharge detection current i. Then, it is determined if an absolute value of the measured self discharge detection current i is greater than the first threshold value (Step S3). If YES, the operation precedes to Step S4 to initiate the electricity removal operation. Subsequently, the self discharge detection current i is measured in Step S5, and the electricity removal operation continues until the absolute value of the self discharge detection current i becomes smaller than the second threshold value. When the absolute value of the self discharge detection current i becomes smaller than the second threshold value, the electricity removal operation is terminated in Step S6. With this, the electricity removal apparatus returned to the halt period in the halt mode, and monitoring of the emergence of the charged body, i.e., the occurrence of the self discharge is continued, and the electricity removal apparatus can stand-by in the halt state.

Figure 19:
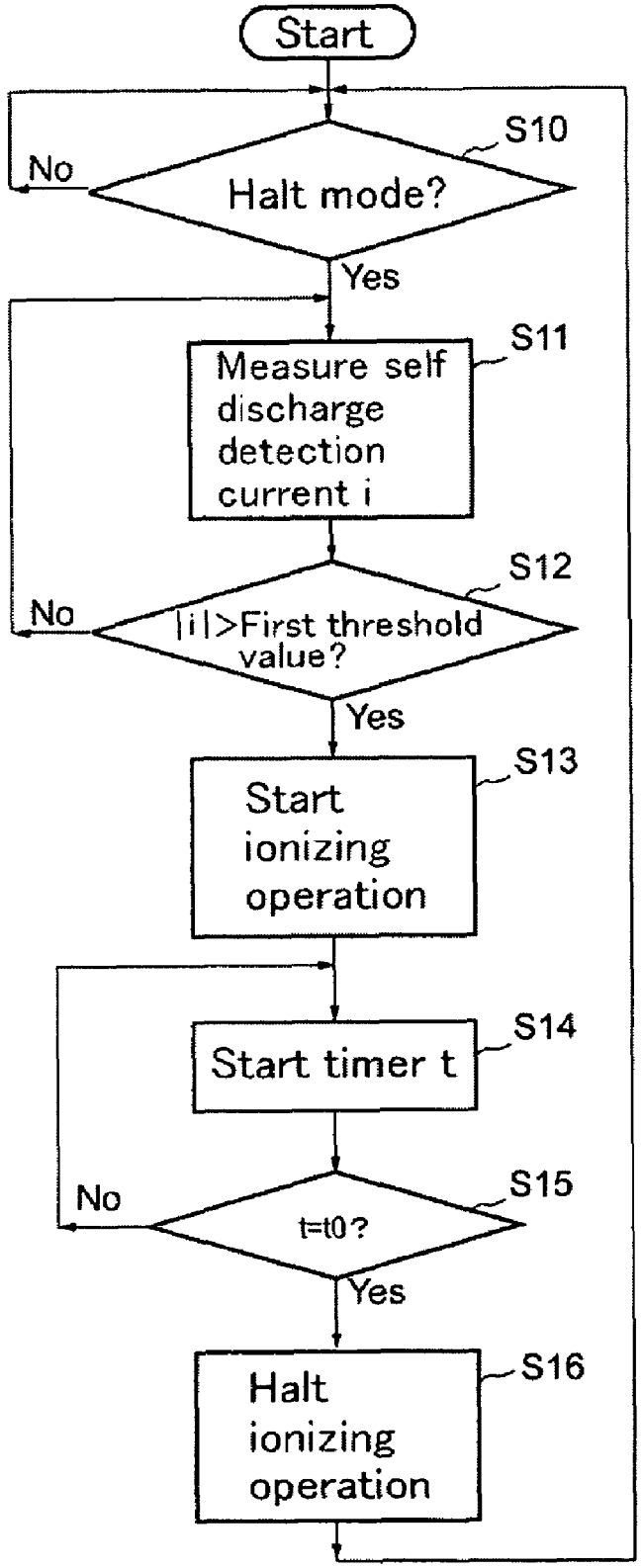
FIG. 19 shows a flowchart of a control example shown in FIG. 9, in which the electricity removal operation is performed when the charged body is detected by an internal circuit of the electricity removal apparatus during the halt period in the halt mode, and that the electricity removal operation is initiated using a threshold value and terminated using a timer.

The flowchart in FIG. 19 corresponds to the control in which the electricity removal operation is terminated using the timer as explained with reference to FIG. 9. With reference to the flowchart in FIG. 19, in Step S10, whether or not the halt mode is set is determined, and if YES (halt mode is set), the self discharge detection current i is measured in Step S11, and it is determined if an absolute value of the measured self discharge detection current i is greater than the first threshold value (Step S12). If YES, the operation precedes to Step S13 to initiate the electricity removal operation. Subsequently, the timer is actuated in Step S14, and when the timer time t reaches a predetermined time t0, the operation precedes to Step S15 to stop the electricity removal operation. With this, the electricity removal apparatus returns to the halt period in the halt mode. With this, the electricity removal apparatus resumed to the halt period in the halt mode, and monitoring of the emergence of the charged body, i.e., the occurrence of the self discharge, is continued.

Figure 20:
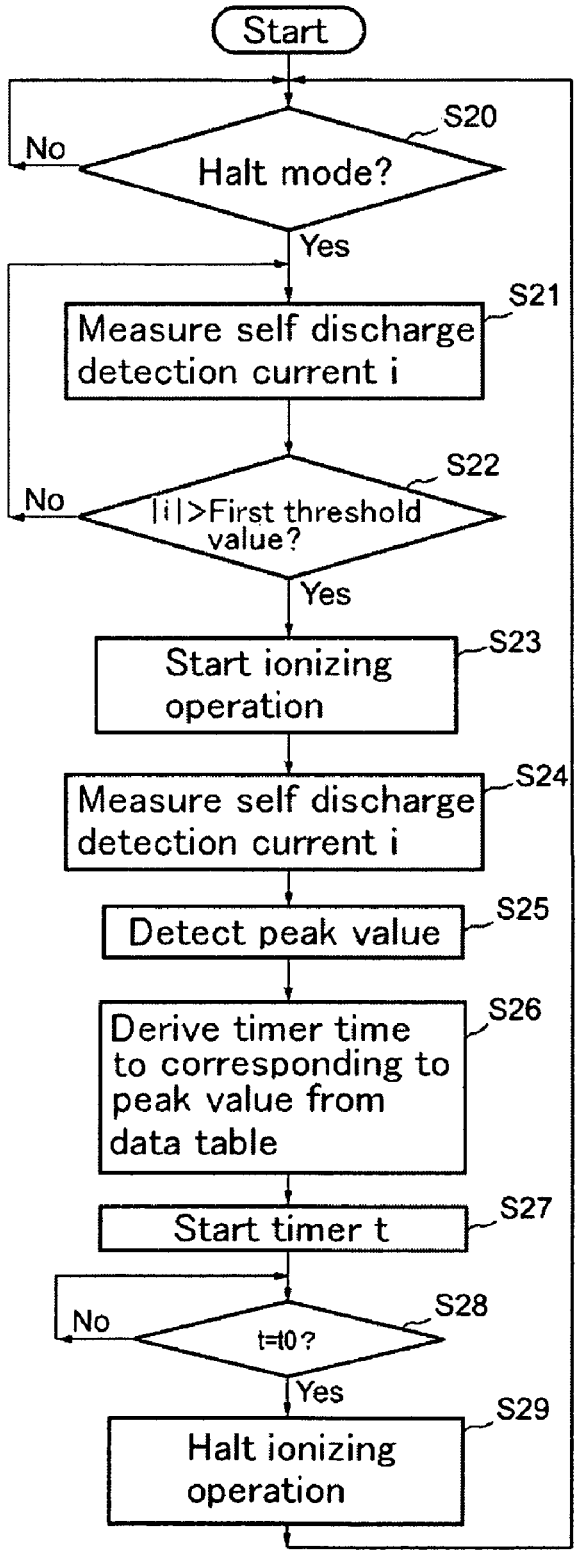
FIG. 20 shows a flowchart of a control example shown in FIG. 10, in which the electricity removal operation is performed when the charged body is detected by an internal circuit of the electricity removal apparatus during the halt period in the halt mode, and that the electricity removal operation is initiated using a threshold value and terminated using a timer and the timer time is adjusted.

The flowchart in FIG. 20 corresponds to the control in which the timer time as explained with reference to FIG. 10 is variable. With reference to the flowchart in FIG. 20, in Step S20, whether or not the halt mode is set is determined, and if YES (halt mode is set), the self discharge detection current i is measured in Step S21, and it is determined if an absolute value of the measured self discharge detection current i is greater than the first threshold value (Step S22). If YES, the operation precedes to Step S23 to initiate the electricity removal operation. Then, the self discharge detection current i is measured in Step S24, a peak value of ground current is detected based on the self discharge detection current i (Step S25), and the timer time t0 corresponding to the peak value is derived from a data table (Step S26). Subsequently, the timer is set to the timer time t0 and the time t is actuated (Step S27), and when the timer time t reaches a predetermined time t0 that has been set (Step S28), the electricity removal operation is stopped (Step S29). With this, the electricity removal apparatus returns to the halt period in the halt mode. With this, the electricity removal apparatus resumed to the halt period in the halt mode, and monitoring of the emergence of the charged body, i.e., the occurrence of the self discharge is continued.

Figure 21:
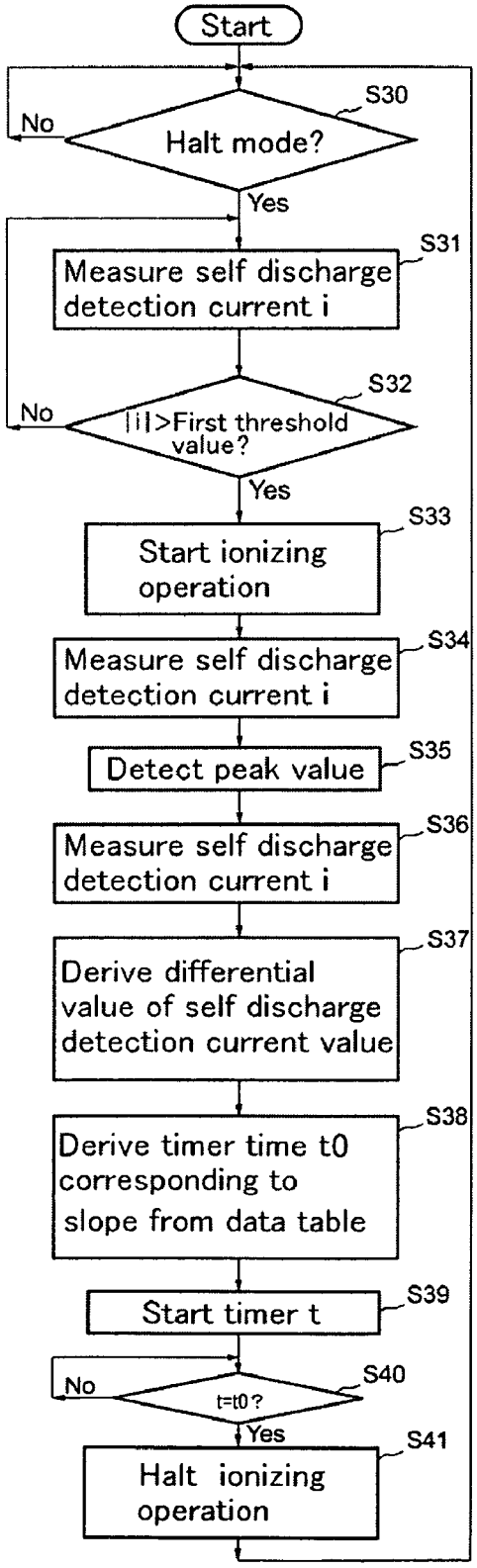
FIG. 21 shows a flowchart of a control example shown in FIG. 11, in which the electricity removal operation is performed when the charged body is detected by an internal circuit of the electricity removal apparatus during the halt period in the halt mode, and that the electricity removal operation is initiated using a threshold value and terminated using a timer and the timer time is adjusted.

The flowchart in FIG. 21 corresponds to the control as explained with reference to FIG. 11. With reference to the flowchart in FIG. 21, in Step S30, whether or not the halt mode is set is determined, and if YES (halt mode is set), the self discharge detection current i is measured in Step S31, and it is determined if an absolute value of the measured self discharge detection current i is greater than the first threshold value (Step S32). If YES, the operation precedes to Step S33 to initiate the electricity removal operation. Then, the self discharge detection current i is measured in Step S34, and a peak value of ground current is detected based on the self discharge detection current i (Step S35). After detecting the peak value, the operation precedes to Step S36 to measure the self discharge detection current i, and a slope is derived from a derivative value of the self discharge detection current i (Step S37). Then, the timer time t0 corresponding to the derived slope is derived from a data table (Step S38). Subsequently, the timer is set to the timer time t0 and the time t is actuated (Step S39), and when the timer time t reaches a predetermined time t0 that has been set (Step S40), the electricity removal operation is stopped (Step S41). With this, the electricity removal apparatus returns to the halt period in the halt mode. With this, the electricity removal apparatus returns to the halt period in the halt mode, and monitoring of the emergence of the charged body, i.e., the occurrence of the self discharge is continued.

Figures 22A, 22B:
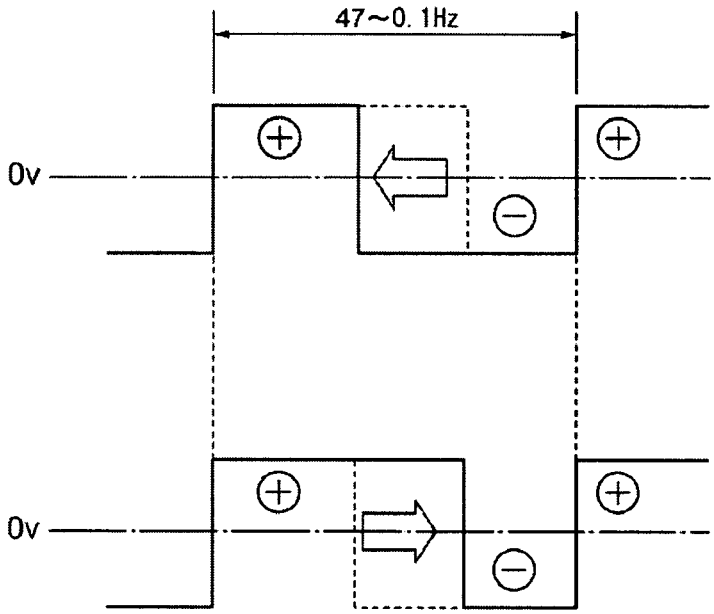
FIGS. 22A and 22B show a diagram for illustrating a specific method for controlling an ion balance included in the electricity removal apparatus of the embodiment.
Figure 23:
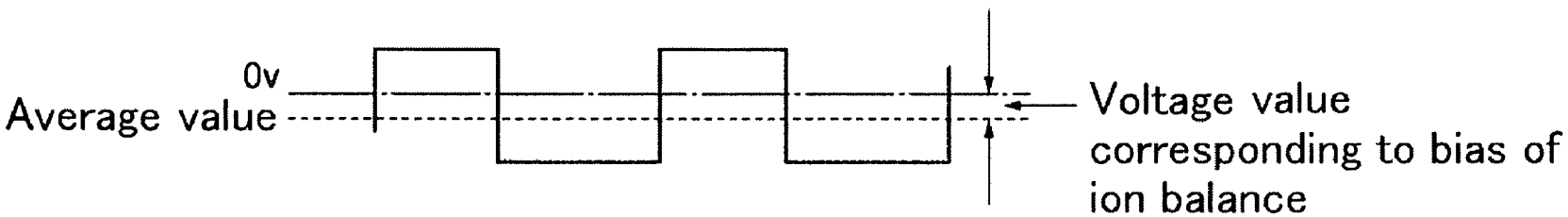
FIG. 23 shows a diagram for illustrating a specific method for controlling an ion balance included in the electricity removal apparatus of the embodiment, and a control example in which an average value of plus and minus high voltages is changed by a value corresponding to the ion balance bias.

In the above described electricity removal apparatus 100, when the ion balance in the area for the electricity removal is biased during the operation in the halt mode, it is preferable to perform a control to maintain the ion balance appropriately as shown in FIG. 22 and FIG. 23, for example. The ion balance control as shown in FIG. 22 is a control (duty ratio control) in which a pulse width of a pulse-shaped high voltage applied on the electrode needle 4 is changed. FIG. 22A shows the control in a case in which the ion balance around the electrode needle 4 is biased to the positive side. In this case, it is controlled so that the pulse width for applying a positive high voltage is smaller. On the other hand, FIG. 22B shows the control in a case in which the ion balance around the electrode needle 4 is biased to the negative side. In this case, it is controlled so that the pulse width for applying a positive high voltage is larger.

While the control example as shown in FIG. 22 is such that the ion balance is maintained appropriately by changing the pulse width of the high voltage, the value of the positive or negative high voltage applied on the electrode needle 4 may also be changed. Further, as shown in FIG. 23, the voltage may be controlled so as to be an average value of values of the positive or negative high voltage corresponding to the degree of the bias of the ion balance. Of course, the values may be averaged digitally. When performing such an ion balance control in the halt mode, it is necessary to perform appropriate sampling of the positive or negative high voltage applied on the electrode needle 4. Moreover, the ion balance control should be appropriately performed preferably using an appropriate averaging technique.

Explaining more specifically regarding this point, the ion balance control is to control the high voltage on the positive side and the high voltage on the negative side applied on the electrode needle 4 so that the balance of the positive and negative ions around the electrode needle 4 becomes appropriate to neutralize the charge of the charged body. In this ion balance control, in the case in which the ion balance control is performed using the duty ratio between the positive and the negative high voltages, for example, when the charged body that is positively charged intrudes into the area for the electricity removal, this charge state is detected and a high voltage adjusted to increase the duty ratio toward the negative side is applied on the electrode needle 4. In order to perform this control appropriately, at least the duty ratio currently used to perform the control and the state of the ion balance in the area for the electricity removal as a result of the current control are preferably reflected on the determination on the duty ratio of the high voltage to be applied on the electrode needle 4 in the next control.

As described above, the halt mode includes the halt period in which ions are not produced around the electrode needle 4. When moving from this halt period to the ion producing period, or from the halt period to the electricity removal operation, the duty ratio currently used to perform the control is not substantially present. Accordingly, reflecting the duty ratio in the halt period on the ion balance control immediately after moving to the ion producing period or the electricity removal operation can easily be a cause of making the ion balance control immediately after moving to the ion producing period or the electricity removal operation inappropriate.

Figure 24:
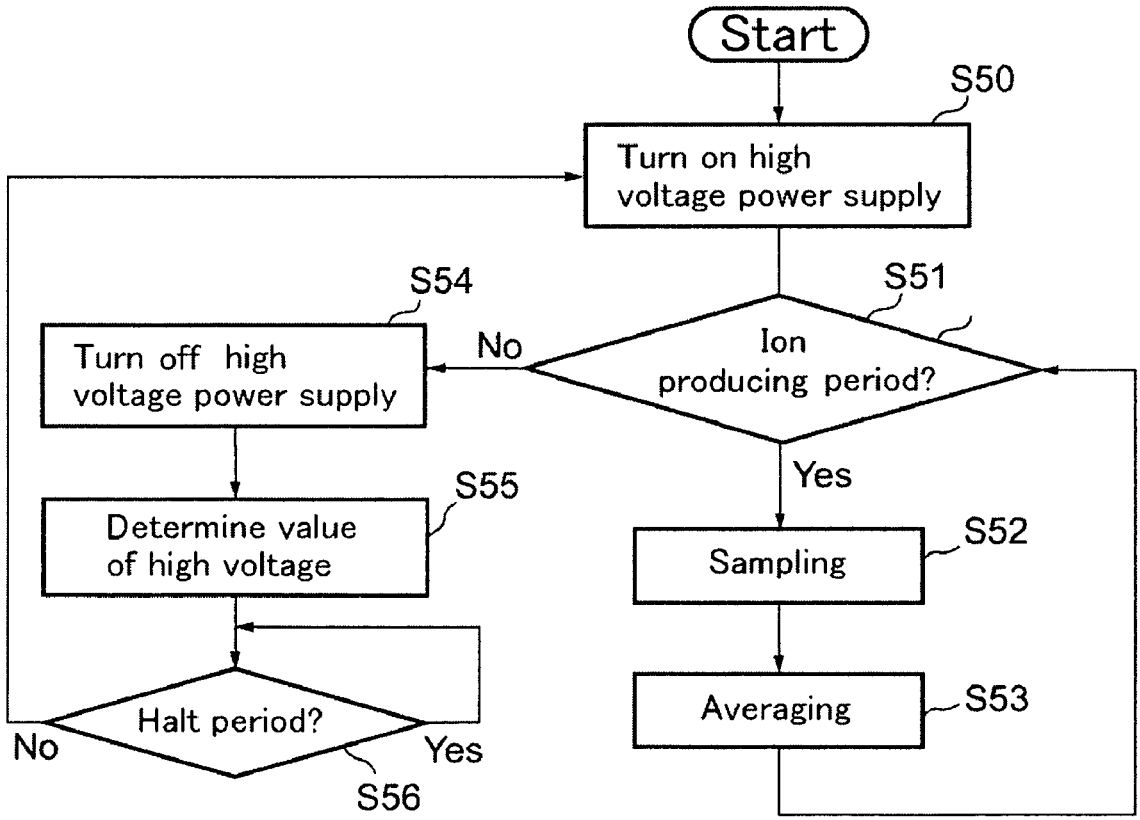
FIG. 24 shows a flowchart showing a control example in which sampling of a value of the voltage applied on the electrode needle is stopped during the halt period in the electricity removal apparatus performing the halt mode including the ion producing period and the halt period.

Further, when employing a method with which a high voltage for ionization is not applied on the electrode needle 4 in the halt period in the halt mode, in order to optimize data for the ion balance control including the halt period, it is appropriate to average the data that has been stored immediately before, or more earlier data. However, averaging the data including the data during the halt period can easily be a cause of making the ion balance control immediately after moving to the ion producing period or the electricity removal operation inappropriate. Specifically, normally, for the electricity removal apparatus, the duty ratio for a high voltage of the positive polarity and a high voltage of the negative polarity applied on the electrode needle 4 is determined based on a single duty ratio or a plurality of duty ratios that has or have been used immediately previously. However, when this is employed in the halt mode including the halt period, setting of an appropriate duty ratio may not be possible. In order to avoid this problem, as shown in the flowchart of FIG. 24, it is preferable that the data sampling during the halt period is stopped, and the latest data in the past ion producing period or the past electricity removal operation is reflected on the control to be performed of the high voltage application for the electrode needle 4. Moreover, it is preferable to average the past data in order to optimize the ion balance control in the high voltage application.

Figure 25:
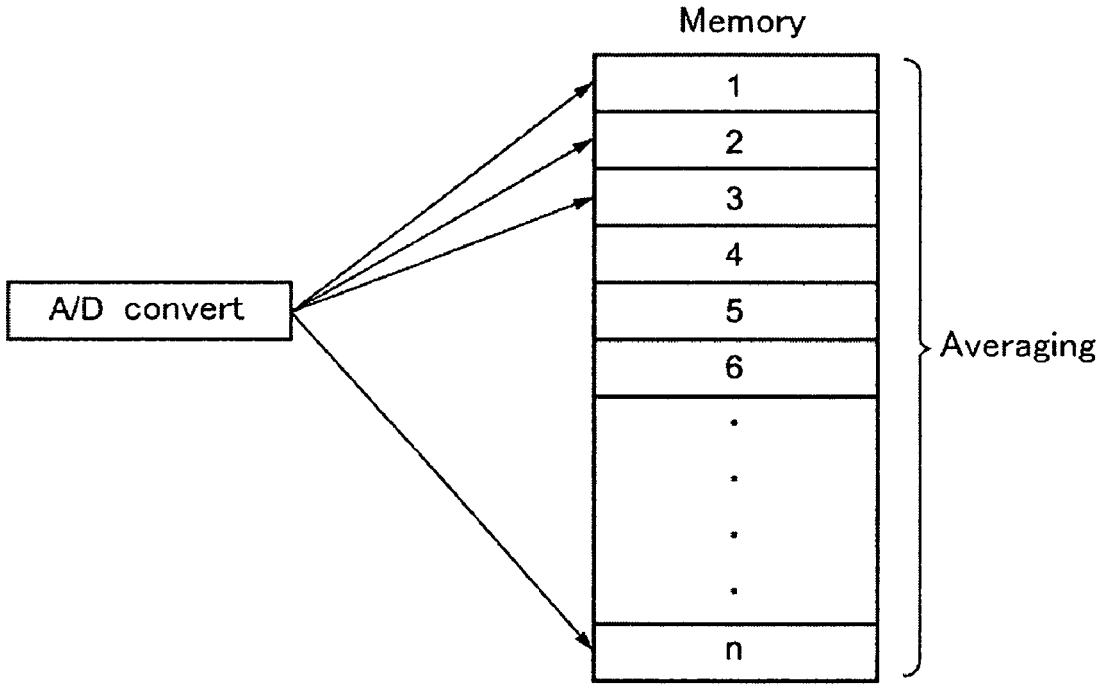
FIG. 25 shows a diagram illustrating that, when data sampled during the ion producing period in FIG. 24 is stored in a memory, transfer to the memory can be canceled during the halt period by digital processing.

FIG. 24 is a flowchart performed according to the halt modes (1) and (2) that include the halt period and the ion producing period, as explained in FIG. 6A and FIG. 6B. First, a high voltage power supply is turned on in Step S50, and then, whether or not it is the ion producing period is determined in Step S51. IfYES, i.e., when ions are produced by the application of a high voltage on the electrode needle 4, the operation proceeds to Step S52. The sampling of the duty ratio of the high voltage applied on the electrode needle 4, for example, on the positive side and the negative side, and then stored in a memory as shown in FIG. 25. Subsequently, in Step S53, an average value is calculated based on a predetermined number of pieces of sampling data, and the average value is stored in the memory and the ion balance control is performed based on the average value.

When switched from the ion producing period to the halt period, the operation proceeds from Step S51 to Step S54 to turn off the high voltage power supply. Then, in Step S55, a value or duty ratio of a high voltage to be applied on the electrode needle 4 that is next performed based on the average value stored in the memory is determined, and the determined value is stored in the memory. When the halt period is terminated, a high voltage is supplied to the electrode needle 4 from the high voltage power supply based on the value or duty ratio determined in the halt period. Specifically, in the halt period, the sampling of the duty ratio is not performed, for example. FIG. 25 shows an example of digital processing, and data transfer to the memory may be prohibited in the halt period.

In order to optimize the ion balance control immediately after switching from the halt period to the ion producing period, the ion balance in the area for the electricity removal in the halt period can be detected and stored in the memory, and this can be constantly updated during the halt period. The above described value or duty ratio of a high voltage determined in the halt period can be compensated based on the detected ion balance. Consequently, the compensation can reflect the data of the ion balance in the area for the electricity removal in the end of the halt period upon controlling the high voltage application immediately after the switching.

With this, the duty ratio or the high voltage level appropriate for the ion balance control immediately after moving from the halt period to the ion producing period can be determined. In the halt mode that does not include the ion producing period (FIG. 7A and FIG. 7B), it is preferable that the latest duty ratio or the latest high voltage value as a result of the ion balance control can be sequentially sampled in the electricity removal operation to store, and immediately before starting the electricity removal operation, data stored in the latest electricity removal operation is averaged to determine the value or duty ratio of a high voltage for the high voltage to be applied on the electrode needle 4. With this, it is possible to avoid averaging in the halt period including zero voltage application. Further, the ion balance in the area for the electricity removal in the halt period can be detected and stored in the memory, and this can be constantly updated during the halt period, based on the date immediately before moving to the electricity removal operation, the determined value can be corrected as the value or duty ratio of a high voltage of a high voltage to be applied on the above described electrode needle 4 that is to be next performed.

The ion balance control in the ion producing period can be such that in the early stage after switching to the ion producing period, for example, first, a positive or negative voltage to be applied on the electrode needle 4 is applied based on the value or duty ratio of a high voltage determined in the halt period as an estimated control. In the subsequent ion balance control, the ion balance control as in the electricity removal mode can be performed, that is, the ion balance control based on a feedback control by determining the value or duty ratio of a positive or negative high voltage to be applied on the electrode needle 4 based on the current value that flows through the internal circuit. Specifically, in the early stage of the ion producing period, the ion balance control is performed as the estimated control based on the data determined in the halt period, and the ion balance control switching to the feedback control in the subsequent ion balance control. Further, as a modified example, it is preferable that, in the early stage of the ion producing period, the ion balance control is performed as the estimated control based on the data determined in the halt period, and then, the ion balance control is performed based on the current value that flows through the internal circuit while correcting the data based on the data determined in the halt period.

In the halt mode that does not include the ion producing period (FIG. 7A and FIG. 7B), it is preferable that the ion balance data relating to the value and the direction of the current that flows through the internal circuit relating to the ion balance in the electricity removal operation on the halt period is stored in memory so that, for example, by using the ion balance data of the result of an application of the high voltage applied to the electrode needle 4 in the most recent electricity removal operation, the ion balance control in the early stage of the next electricity removal operation can be performed. Then, in the following of the early stage, the ion balance control can be switched to the feedback control as described above. It is also preferable that the ion balance control in the early stage of the subsequent electricity removal operation is performed as an estimated control using the ion balance data stored in the electricity removal operation, and then, correcting based on the current value that flows through the internal circuit to perform the ion balance control (for example, duty ratio control).

As described above, the embodiment is explained using the example in which high voltages of opposite polarities are applied on the common electrode needle 4 to alternately produce positive and negative ions. However, it should be understood that the present invention can also be applied to an electricity removal apparatus in which a pair of electrode needles respectively are applied with positive and negative high voltage to produce positive ions and negative ions as described as embodiment shown in FIG. 16 and FIG. 17 of Japanese Unexamined Patent Publication No. 2000-58290. Specifically, the self discharge detection circuit can be provided respectively between the positive and negative electrode needles and the ground, and when the self discharge is detected at any of the electrode needles, a high voltage that is the same as in the electricity removal mode can be applied on the electrode needle to perform the electricity removal operation. Further, it should be understood that, in the halt period in the halt mode, a voltage that does not produce ions, i.e., a voltage to increase the sensitivity for detecting the charged body (2 kV, for example) can be applied on the electrode needle.

What is claimed is:

1. An electricity removal apparatus producing an ion to neutralize a charged object, comprising:

an electrode to produce the ion;

a voltage circuit connected to the electrode for generating a positive voltage and a negative voltage of electrical power to supply the electrical power to the electrode;

a self discharge detection circuit for detecting a self discharge of the electrode; and a control unit for controlling the positive voltage and the negative voltage generated by the voltage circuit to one of a first condition in which the electrode does not produce the ion actively and a second condition in which the electrode produces the ion actively, shifting a voltage for the electrode corresponding to the first condition into a voltage for the electrode corresponding to the second condition when the self discharge is detected by the self discharge detection circuit, and shifting a voltage for the electrode corresponding to the second condition into a voltage for the electrode corresponding to the first condition when a requirement for termination is met.

2. The electricity removal apparatus according to claim 1, wherein the self discharge detection circuit includes a circuit for detecting a value of current flowing through a resistance provided between the electrode and the voltage circuit.

3. The electricity removal apparatus according to claim 1, wherein the self discharge detection circuit includes a circuit for detecting a value of current that flows through a resistance provided between the electrode and a ground.

4. The electricity removal apparatus according to claim 2, wherein the self discharge detection circuit includes a portion for detecting that an absolute value of the current flowing through the resistance, exceeds a first threshold value as the self discharge is detected.

5. The electricity removal apparatus according to claim 2, wherein the control unit determines that the absolute value of the current flowing through the resistance, goes below a second threshold value as the requirement for termination is met.

6. The electricity removal apparatus according to claim 1, wherein the control unit determines that a predetermined time period has passed after the shifting the voltage for the electrode corresponding to the first condition into the voltage for the electrode corresponding to the second condition as the requirement for termination is met.

7. The electricity removal apparatus according to claim 2, further comprising:

a peak value detecting unit that detects a peak value of the current flowing through the resistance, wherein the control unit determines that a predetermined time period has passed after shifting the voltage for the electrode corresponding to the first condition into the voltage for the electrode corresponding to the second condition as the requirement for termination is met; and the predetermined time period is adjusted according to a level of an absolute value of the peak value detected by the peak value detecting unit, such that the predetermined time period is extended compared to a case in which the peak value is smaller when the absolute value of the peak value is greater, and the predetermined time period is reduced compared to a case in which the peak value is greater when the absolute value of the peak value is smaller.

8. The electricity removal apparatus according to claim 2, further comprising:

a peak value detecting unit that detects a peak value of the current flowing through the resistance; and a current reduction speed detecting unit that detects a reduction speed at which an absolute value is reduced when the absolute value of the peak value of the current flowing through the resistance is getting smaller, wherein the control unit determines that a predetermined time period has passed after the shifting the voltage for the electrode corresponding to the first condition into the voltage for the electrode corresponding to the second condition as the requirement for termination is met; and the predetermined time period is adjusted according to the reduction speed detected by the current reduction speed detecting unit when the absolute value of the peak value is reduced, such that the predetermined time period is extended compared to a case in which the reduction speed is greater when the reduction speed is smaller, and the predetermined time period is reduced compared to a case in which the reduction speed is smaller when the reduction speed is greater.

9. The electricity removal apparatus according to claim 1, wherein the voltage corresponding to the first condition is a voltage of the electrode in a condition that the voltage circuit does not supply any voltage on the electrode.

10. The electricity removal apparatus according to claim 1, wherein the voltage corresponding to the first condition is a voltage of the electrode in a condition that no ions are produced around the electrode.

11. The electricity removal apparatus according to claim 1, wherein the control unit gradually reduces the voltage corresponding to the second condition to the voltage corresponding to the first condition when the requirement for termination is met.

12. The electricity removal apparatus according to claim 1, wherein the control unit gradually increases the voltage corresponding to the first condition to the voltage corresponding to the second condition when the self discharge is detected by the self discharge detection circuit.

13. The electricity removal apparatus according to claim 1, further comprising a mode selector for manually selecting a mode from a group of a first mode in which the control unit maintains the voltage corresponding to the second condition even if the requirement for termination is met and a second mode in which the control unit shifts the voltage for the electrode corresponding to the second condition into the voltage for the electrode corresponding to the first condition when the requirement for termination is met.

14. The electricity removal apparatus according to claim 1, further comprising a first output unit for generating a first signal when the self discharge is detected by the self discharge detection circuit, and outputting the first signal to an external device.

15. The electricity removal apparatus according to claim 1, further comprising a second output unit for generating a second signal when the requirement for termination is met, and outputting the second signal to an external device.

16. The electricity removal apparatus according to claim 1, further comprising an ion balance controller for adjusting the voltage for the electrode corresponding to the second condition to control an ion balance;

a memory for storing the voltage for the electrode corresponding to the second condition adjusted by the ion balance controller; and a determining unit for determining a positive and a negative voltage to be supplied for the electrode based on the voltage for the electrode corresponding to the second condition stored in the memory;

wherein the voltage circuit is controlled to supply the positive and the negative voltage determined by the determining unit to the electrode when the self discharge is detected by the self discharge detection circuit.

* * * * *